US011425476B2

(12) United States Patent
Christoph et al.

(10) Patent No.: US 11,425,476 B2
(45) Date of Patent: Aug. 23, 2022

(54) SYSTEM AND METHOD FOR ADAPTIVE CONTROL OF ONLINE EXTRACTION OF LOUDSPEAKER PARAMETERS

(71) Applicant: Harman Becker Automotive Systems GmbH, Karlsbad (DE)

(72) Inventors: Markus E. Christoph, Straubing (DE); John Barry French, Port Carling (CA)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 17/135,311

(22) Filed: Dec. 28, 2020

(65) Prior Publication Data

US 2021/0204043 A1 Jul. 1, 2021

Related U.S. Application Data

(60) Provisional application No. 62/955,125, filed on Dec. 30, 2019.

(51) Int. Cl.
*H04R 1/00* (2006.01)
*H04R 3/00* (2006.01)
(Continued)

(52) U.S. Cl.
CPC ..... *H04R 1/005* (2013.01); *H04R 3/002* (2013.01); *H04R 3/04* (2013.01); *H04R 29/001* (2013.01); *H04R 2400/13* (2013.01)

(58) Field of Classification Search
CPC ..... H04R 1/005; H04R 3/002; H04R 3/04; H04R 29/001; H04R 2400/13;
(Continued)

(56) References Cited

U.S. PATENT DOCUMENTS 5,537,479 A * 7/1996 Kreisel ..... H04R 1/02 381/89
8,761,409 B2 * 6/2014 Pfaffinger ..... H04R 29/001 381/59
(Continued)

FOREIGN PATENT DOCUMENTS

EP 2538699 A1 12/2012
EP 3734994 A1 11/2020
(Continued)

OTHER PUBLICATIONS

European Search Report for Application No. 20217736.6 dated May 6, 2021, 8 pgs.
(Continued)

*Primary Examiner* — Xu Mei
(74) *Attorney, Agent, or Firm* — Brooks Kushman P.C.

(57) ABSTRACT

In at least one embodiment, an audio system for extracting online parameters is provided. The system includes a loudspeaker and at least controller. The loudspeaker transmits an audio signal in a listening environment. The at least one controller includes a signal processing block and an adaptive filter. The signal processing block is programmed to provide a driving signal u(n) to drive the loudspeaker to transmit the audio signal. The adaptive filter is programmed to receive the driving signal and to receive a first varying signal i(n) from the loudspeaker in response to the loudspeaker transmitting audio signal. The adaptive filter is further programmed to generate an admittance curve for the loudspeaker based at least on the driving signal and the first varying signal.

23 Claims, 20 Drawing Sheets

(51) Int. Cl.
*H04R 3/04* (2006.01)
*H04R 29/00* (2006.01)

(58) Field of Classification Search
CPC .... H04R 29/00; H04R 29/002; H04R 29/003; H04R 29/008
USPC ..... 381/55, 59, 96
See application file for complete search history.

(56) References Cited

U.S. PATENT DOCUMENTS

| | | | | |
|---|---|---|---|---|
| 10,602,288 | B1 * | 3/2020 | French | H04R 3/08 |
| 10,667,040 | B1 | 5/2020 | French | |
| 2003/0118193 | A1 * | 6/2003 | Leske | H04R 29/003 381/59 |
| 2014/0064502 | A1 | 3/2014 | Parrot | |
| 2015/0319529 | A1 * | 11/2015 | Klippel | H04R 3/007 381/55 |
| 2016/0173983 | A1 | 6/2016 | Berthelsen et al. | |
| 2016/0309255 | A1 * | 10/2016 | Marcone | H04R 3/007 |
| 2018/0302714 | A1 * | 10/2018 | Hu | H04R 29/001 |

FOREIGN PATENT DOCUMENTS

| | | | |
|---|---|---|---|
| WO | 2017187169 | A1 | 11/2017 |
| WO | 2017202460 | A1 | 11/2017 |
| WO | 2019143150 | A1 | 7/2019 |

OTHER PUBLICATIONS

Partial European Search Report for Application No. 20217588.1 dated May 19, 2021, 14 pgs.
Bright, A., "Active control of loudspeakers: An investigation of practical applications", Jan. 1, 2002, 204 pgs.
Maximilian, M., "Group delay and phase delay example", Jul. 26, 2018, 6 pgs.

* cited by examiner $$NLF(e^{j\Omega,n}) = \sqrt{\frac{|E(e^{j\Omega,n})|^2}{|U(e^{j\Omega,n})|^2}}$$

SYSTEM AND METHOD FOR ADAPTIVE CONTROL OF ONLINE EXTRACTION OF LOUDSPEAKER PARAMETERS

CROSS-REFERENCE TO RELATED APPLICATIONS

This application claims the benefit of U.S. provisional application Ser. No. 62/955,125 filed Dec. 30, 2019, the disclosure of which is hereby incorporated in its entirety by reference herein. This application may also generally relate to U.S. provisional application Ser. No. 62/955,138 filed Dec. 30, 2019 ("the '138 application") entitled "SYSTEM AND METHOD FOR PROVIDING ADVANCED LOUDSPEAKER PROTECTION WITH OVER-EXCURSION, FREQUENCY COMPENSATION AND NON-LINEAR CORRECTION, U.S. provisional application Ser. No. 62/955,149 ("the '149 application") filed Dec. 30, 2019 entitled "SYSTEM AND METHOD FOR COMBINING AN ADVANCED LOUDSPEAKER PROTECTION WITH AN AUTOMATICALLY ADJUSTABLE SPECTRAL COMPRESSOR" and U.S. provisional application Ser. No. 62/955,141 ("the '141 application") filed Dec. 30, 2019 entitled "SYSTEM AND METHOD FOR PROVIDING A LINEARIZER FOR LOUDSPEAKER APPLICATIONS" the disclosures of which are hereby incorporated in their entirety by reference herein.

TECHNICAL FIELD

One or more aspects disclosed herein generally related to a system and method for adaptive control of online extraction of loudspeaker parameters. These aspects and others will be discussed in more detail below.

BACKGROUND

Current loudspeaker implementations are based on previously measured loudspeaker parameters or functions such as an impedance curve of the loudspeaker, which incorporates some deficiencies, as loudspeaker parameters, in principle, vary over playback volume (applied sound pressure level), time, temperature, aging, individual variations and so on. Hence, any control algorithm, based on such loudspeaker dependent parameters, such as a (thermal) limiter, cannot optimally perform. By introduction of a system able to estimate those desired/required loudspeaker parameters in real time, in an automated, respectively adaptive manner, is highly desired.

SUMMARY

In at least one embodiment, an audio system for extracting online parameters is provided. The system includes a loudspeaker and at least controller. The loudspeaker transmits an audio signal in a listening environment. The at least one controller includes a signal processing block and an adaptive filter. The signal processing block is programmed to provide a driving signal u(n) to drive the loudspeaker to transmit the audio signal. The adaptive filter is programmed to receive the driving signal and to receive a first varying signal i(n) from the loudspeaker in response to the loudspeaker transmitting audio signal. The adaptive filter is further programmed to generate an admittance curve for the loudspeaker based at least on the driving signal and the first varying signal.

In at least another embodiment, a computer-program product embodied in a non-transitory computer read-able medium that is programmed for extracting online parameters associated with a loudspeaker is provided. The computer-program product includes instructions for providing a driving signal u(n) to drive the loudspeaker to transmit an audio signal and receiving a varying signal i(n) from the loudspeaker in response to the loudspeaker transmitting audio signal. The computer-program product includes instructions for generating one of an admittance curve or an impedance curve for the loudspeaker based at least on the driving signal and the varying signal.

In at least another embodiment, a method for extracting online parameters associated with a loudspeaker is provided. The method includes providing a driving signal u(n) to drive the loudspeaker to transmit an audio signal and receiving a varying signal i(n) from the loudspeaker in response to the loudspeaker transmitting audio signal. The method further includes generating an admittance curve or an impedance curve for the loudspeaker based at least on the driving signal and the varying signal.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
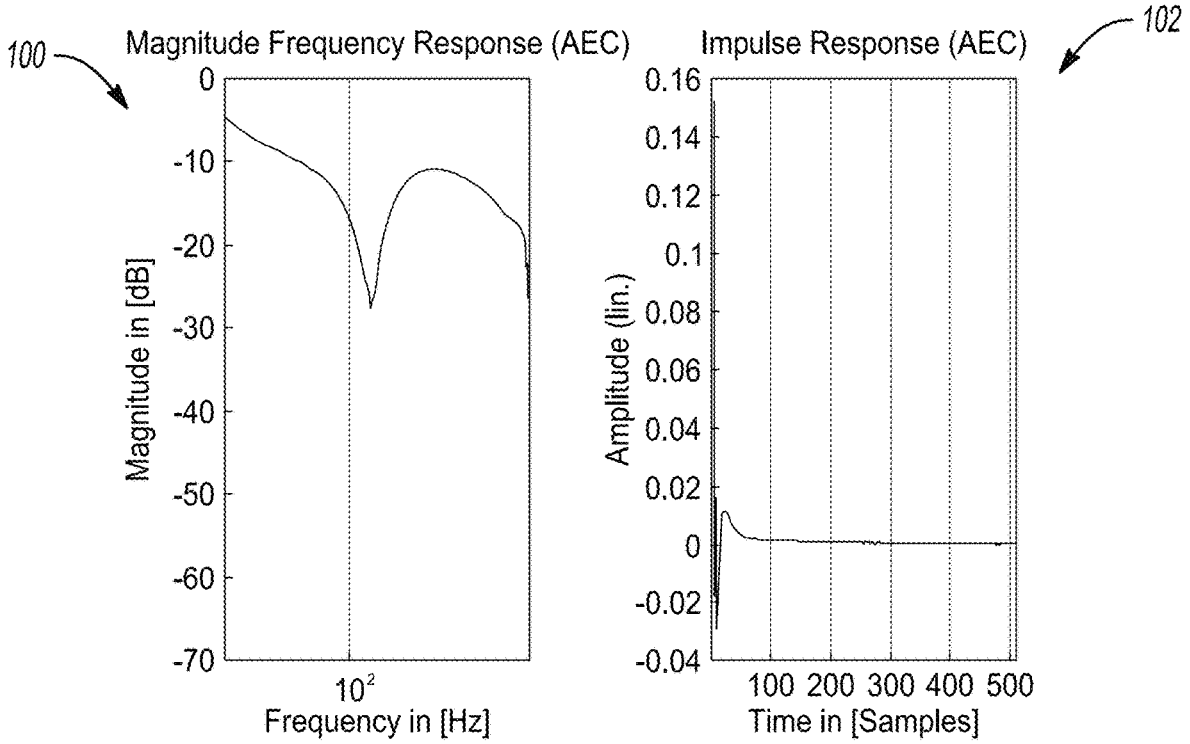
FIG. 1 depicts a first plot for a magnitude frequency response of an admittance of a loudspeaker and a second plot for its corresponding impulse response.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers/devices as disclosed herein and in the attached Appendix may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein. While the various systems, blocks, and/or flow diagrams as noted herein refer to time domain, frequency domain, etc., it is recognized that such systems, blocks, and/or flow diagrams may be implemented in any one or more of the time domain, frequency domain, etc.

The aspects as set forth herein may provide, but not limited to, an optimization of a loudspeaker via electronic processing. The word optimized may be understood in many different ways. For example, optimization may correspond to using an existing loudspeaker to obtain the most (e.g. power) out of it, without causing the loudspeaker to malfunction or being destroyed. Optimization may also correspond, to meeting specific targets, as, for example, provided within a specification of a customer (e.g. minimum power) keeping the loudspeaker as small, respectively as lightweight as possible. Such a method may be interesting for all different applications, e.g. speakers in cars (e.g. to keep the overall weight as low as possible, without making compromises of the sound quality and/or of the sound pressure level (SPL)), but in particular for devices, in which small loudspeakers are used (e.g. Smart Phones, Laptops, Smart Speakers, Soundbars, etc.).

Now after the necessity of such a system, it is possible to contemplate that such an optimizer can be realized and, at the same time, what constraints may be considered. A natural way to start is to look at the options of how to protect a loudspeaker from malfunction or from being damaged. Various ways to protect the loudspeaker may include the utilization of one or more of the following:

A limiter for protection: which may cause acoustical artifacts and does not make use of a physical potential of the loudspeaker at for example low frequencies;

A multi-band-limiter (MBL): by splitting up the input signal in sub-bands and applying a (protection) limiter to each of those sub-bands in a specific manner, reflecting the properties of the given loudspeaker, a much better performance (especially) at low frequencies (Bass) can be achieved. However, the MBL has to be adjusted/tuned, which may require some effort.

Thermal protection: for example, a measured impedance curve may be used to estimate the current as well as long-term power consumption of the loudspeaker based on the speaker-specific tuning protect for short-term as well as long-term thermal damages. However, (e.g., manual) tuning may be necessary. In addition, the impedance of the loudspeaker may change over time due to heat and due to the volume/structure that it is actually coupled to (e.g. if mounted in a door of a vehicle).

Current solutions may not be adequate enough or may require for a demanding tuning effort to obtain more out of the given loudspeaker. Even if well-tuned, those systems, which may be based on a single measurement or a single condition, may not be optimal, since various properties of the loudspeaker may change under certain conditions. Such conditions may not be foreseen, as already mentioned above. It may be desirable for an online measurement to constantly update certain loudspeaker parameters to enable an adaptive control of those protection units.

Embodiments as set forth herein may be based on a realization of an online parameters extraction implementation that may be used in connection with the '138 application as set forth above.

1. Online Parameter Extraction

There may exist several possibilities to extract desired parameters (small-, respectively large signal parameters) from an unknown loudspeaker. For example, Klippel provides a measurement system, such as a laser to measure the excursion of the membrane of the speaker, from various loudspeaker specific parameters that may be extracted. Systems based on acoustical measurements using a microphone and/or an accelerometer, being either in close proximity or directly mounted on the loudspeaker (e.g. membrane) are also known in this regard. In addition, current-voltage measurements which drive the loudspeaker and its corresponding current may be yet another way to measure certain loudspeaker parameters.

For the realization of an over-excursion limiter as well as the thermal limiter, necessary loudspeaker parameters may be obtained from a current impedance curve, respectively, its admittance curve. This may readily be gained by measuring an actual driving signal (voltage and current) of the loudspeaker, which may be the most simple and cost-effective of all noted possibilities.

Figure 2:
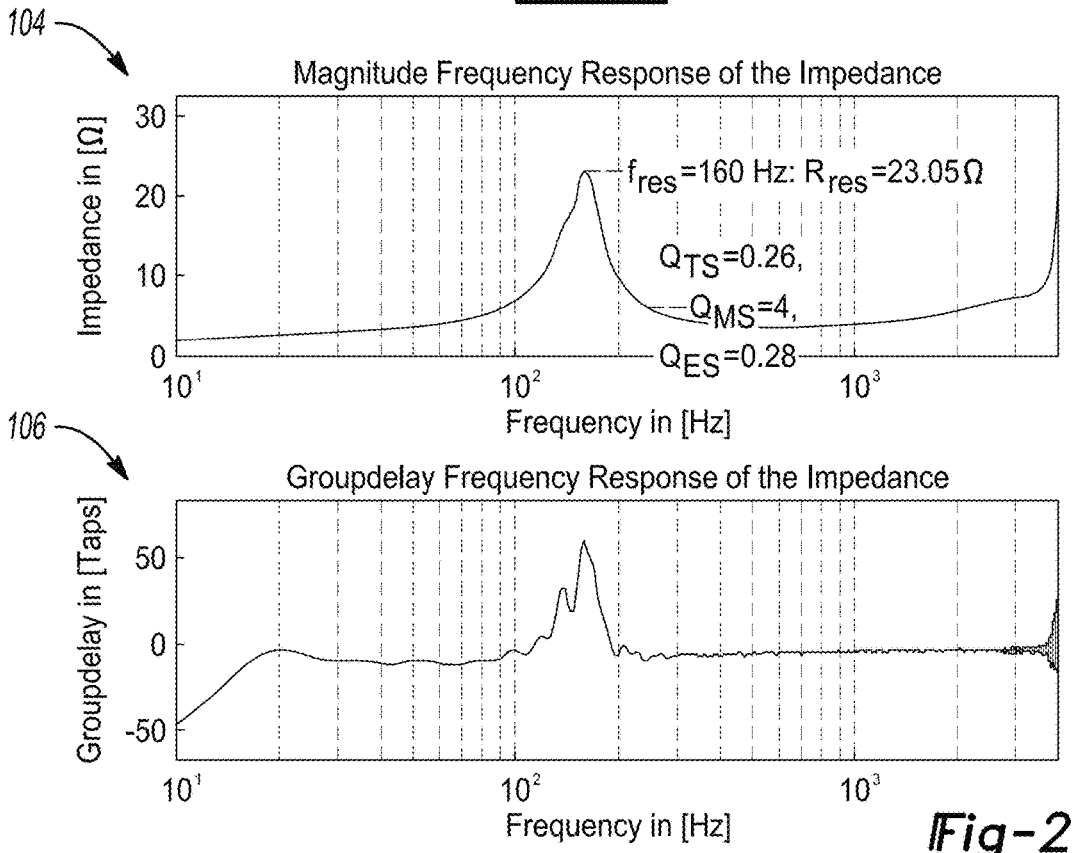
FIG. 2 depicts a first plot for a magnitude frequency response of an impedance for the loudspeaker and a second plot of a group delay frequency response of the impedance.

Despite the fact, that the impedance curve may be the most prominently used curve, it has been discovered that it may be more effective to base the parameter extraction on an adaptively estimated admittance curve (see corresponding plots of FIG. 1). For example, FIG. 1 depicts a first plot 100 for a magnitude frequency response of an admittance curve for a loudspeaker and a second plot 102 for a corresponding impulse response thereof FIG. 2 depicts a first plot 104 for a magnitude frequency response of an impedance for the loudspeaker and a second plot 106 of a group delay frequency response of the impedance Referring to FIG. 1 (see first plot 100), it can be seen that the admittance curve has a more spectrally broad character, with a small but deep notch at the resonance frequency of the loudspeaker. The corresponding impedance curve as illustrated in FIG. 2 (see first plot 104), which is given by the inverse of the admittance curve, naturally has, at the resonance frequency, a high peak. This may resemble the shape of a peaking-filter. This spectral character makes it easier to estimate the admittance curve, especially with an adaptive FIR filter of a limited short length as directly estimating the impedance curve, which is possible, but may require, on one hand, a longer FIR filter. However, on the other hand, this may require a longer lead time to converge, due to a lesser amount of energy of the desired signal. In addition, the latter may also lead to a higher degree of susceptibility to noise within the measurement signals and therefrom to a less robust estimation of the curve.

Within the corresponding impedance curve in the first plot 104 of FIG. 2, some of the desired speaker parameters are illustrated, as for example, the currently estimated resonance frequency ($f_{res}$), which may be extracted from its group delay, which is illustrated in the second plot 106 of FIG. 2. Through inspection of the second plot 106, it may be realized that the group delay frequency response includes a clearer and hence an easier way to detect the peak in addition to a resistance at the resonance frequency ($R_{res}$), quality of the mechanical system ($Q_{ms}$), quality of the electrical system ($Q_{ES}$), as well as of the quality of the total (complete) system ($Q_{TS}$) (e.g., online estimation parameters). Other loudspeaker parameters that may also be extracted, but not illustrated in FIG. 1 may include a DC resistance and corresponding frequency where in terms of where the DC resistance is taken from, as well as an estimated inductance of the loudspeaker.

The inductance may be estimated by a slew rate of the impedance curve. Such as between a frequency point where the DC resistance is taken from (i.e., $2^{nd}$ zero) and a second spectral point at an higher frequency, which may be defined by 2-10 times of the given resonance frequency so that in this case it is ensured that a reactance of the loudspeaker dominates its resistance. Alternatively, the inductance may also be estimated if the resistance at a higher frequency, at which the inductive reactance dominates, is used. Therefore, it is possible to subtract the DC resistance from an (absolute) value thereof and then use the difference to calculate the inductance as illustrated below (e.g., estimation of the inductance):

$$\approx \frac{Z(e^{jQ}, n) - R_{DC}}{2\pi f}$$

With this set of extracted parameters, it is possible to operate the aforementioned over-excursion limiter as well as a thermal limiter, where the thermal limiter may also need the actual current signal for proper operation.

Figure 3:
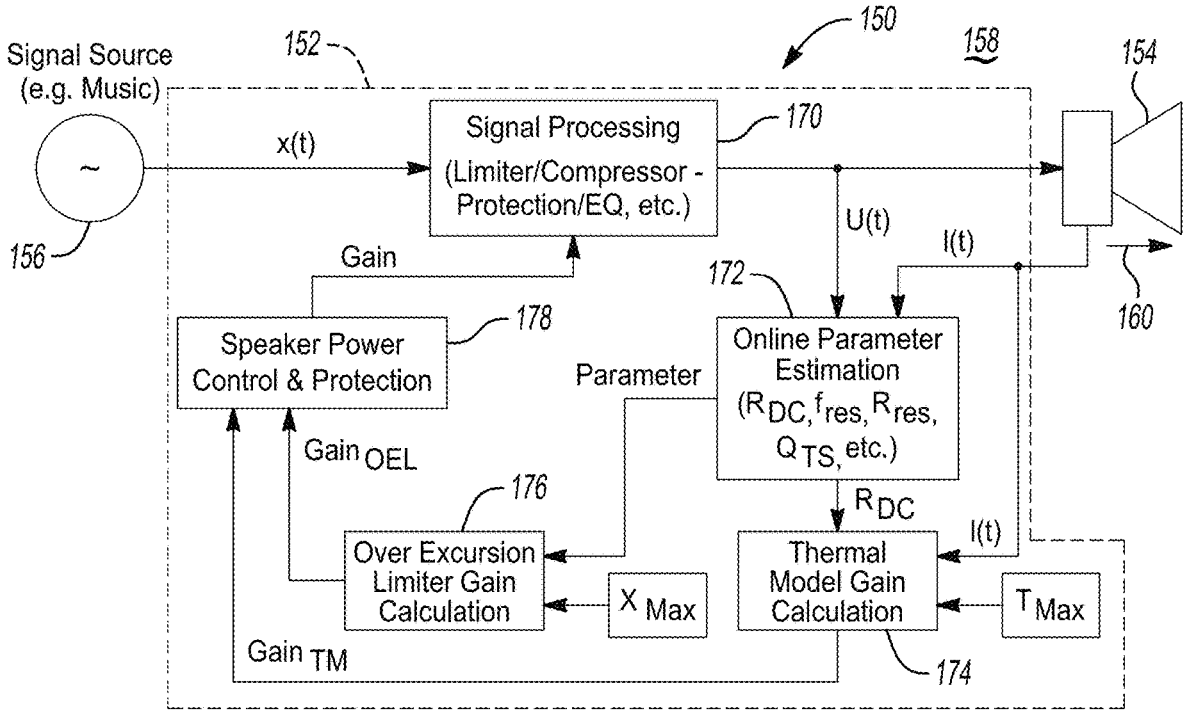
FIG. 3 depicts a system for performing on-line extraction of loudspeaker parameters in accordance to one embodiment.

FIG. 3 depicts a system 150 for performing on-line extraction of loudspeaker parameters in accordance to one embodiment. The system 150 generally includes at least one controller 152 (hereafter "the controller 152") and at least one loudspeaker 154 (hereafter "the loudspeaker 154"). While not shown, it is recognized that the controller 152 is operably coupled to any number of memory devices that stores instructions to enable the controller 152 to execute any number of the noted operations herein. The controller 152 is configured to transmit an audio signal from an audio source 156 to the loudspeaker 154 to play back the audio data in a listening environment 158. The system 150 is configured to, among other things, prevent the loudspeaker 154 from experiencing over-excursion in which a cone (not shown) of the loudspeaker 154 may travel too far in a first axis 160. This condition may minimize distortion and the presence of artifacts in the audio played back in the listening environment. Similarly, the system 150 may also prevent the loudspeaker 154 from experiencing an over temperature condition. This aspect may improve the quality of the audio playback in the listening environment 158.

The controller 152 includes a signal processing block 170 (e.g., a single gain stage), an on-line parameter estimation block 172, a thermal model gain estimation block 174, an over excursion limiter gain calculation block 176, and a loudspeaker control and protection block 178. In general, the over-excursion limiter gain calculation block 176 receives a signal $x_{max}$ which corresponds to a maximum allowed excursion for the loudspeaker 154. The over-excursion limiter gain calculation block 176 generates an over-excursion limiter gain signal (e.g., $Gain_{OEL}$) in response to the signal $x_{max}$ and a signal PARAMETER from the on-line parameter estimation block 172. It is recognized that any one or more of the adaptively extracted parameters (e.g., Rdc, fres, Res, Qts, Impedance, etc.) on the signal PARAMETER may be provided to one or more audio amplifiers as set forth in the '0138 application to limit excursion of a voice coil of the loudspeaker and to limit a temperature for the loudspeaker. The various extracted parameters on the signal PARAMETER as transmitted from the on-line parameter estimation block 172 will be discussed in more detail below.

The thermal model gain estimation block 174 receives a signal $\tau_{max}$ which corresponds to a maximum allowed operation temperature of the loudspeaker 154 and a varying signal (i(t)) (e.g., a current signal that is measured as output by the loudspeaker 154 via a current sensor (not shown FIG. 3) that output from the loudspeaker 154. The values for the signals signal $x_{max}$ and $\tau_{max}$ may be stored in memory (not shown) for the controller 152 and may be provided via a data sheet for the loudspeaker 154. The thermal model gain estimation block 174 generates a thermal limiter gain signal ((e.g., $Gain_{TM}$ to keep the loudspeaker 154 within a maximally allowed temperature range $\tau_{max}$) in response to the signal $\tau_{max}$, the current varying signal i(t), and a DC resistance value (e.g., $R_{DC}$) of a voice coil (not shown) of the loudspeaker 154. The over-excursion limiter gain signal (e.g., $Gain_{OEL}$) generally corresponds to a control signal that is indicative of an amount of excursion that the cone of the loudspeaker 154 may travel along the first axis 160 without experiencing over-excursion. The thermal limiter gain signal (e.g., $Gain_{TM}$) generally corresponds to a control signal that is indicative of a thermal limit at which the loudspeaker 154 is to operate at. The loudspeaker control and protection block 178 generates a gain signal (e.g., Gain) in response to the over-excursion limiter gain signal $Gain_{OEL}$, and the thermal limiter gain signal $Gain_{TM}$ which is transmitted to the signal processing block 170. The signal processing block 170 transmits a signal u(t) (or driving signal) which corresponds to a varying input voltage signal that is provided to the loudspeaker 154 in response to the gain signal from the speaker power and control block 178. The varying input voltage signal u(t) controls the loudspeaker 146 to travel to a maximum linear position, $x_{max}$ on the axis 160 (e.g., the loudspeaker 154 will not travel beyond is maximum position, $x_{max}$) and may further control the loudspeaker 154 to operate within an operating temperature range (e.g. up to the maximum temperature $\tau_{max}$) thereby not exceeding a given maximum $\tau_{max}$. The signal processing block 170 (or the controller 150) may control the varying input voltage signal u(t) to generally control a volume (or SPL) of the loudspeaker 154 in addition to an excursion and power consumption of the loudspeaker 154 which provides the ability of directly influencing a temperature of a voice coil of the loudspeaker 154. Thus, the controller 152 along with the signal u(t) may prevent short term over-excursion as well as long term over-temperature of the voice coil. These aspects may prevent the loudspeaker 154 from being damaged.

Adaptive Filter

Figure 4A:
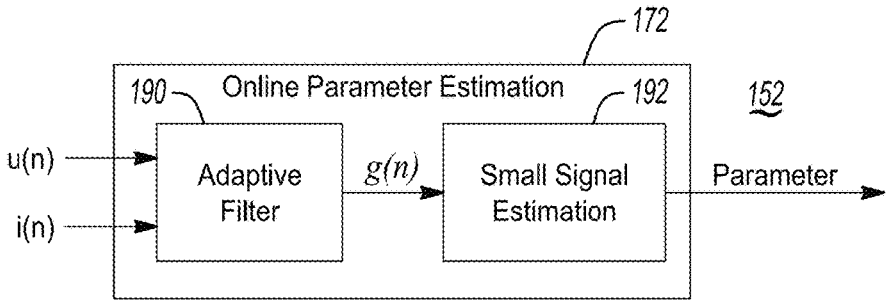
FIG. 4A generally depicts a detailed implementation of an on-line parameter estimation block in accordance to one embodiment.

FIG. 4A generally depicts a high-level system including the controller 152 and along with the on-line parameter estimation block 172 as set forth in FIG. 3 in accordance to one embodiment. The on-line parameter estimation block 172 includes at least one adaptive filter 190 (hereafter "the adaptive filter 190") and a small signal estimation block 192. The adaptive filter 190 is generally configured to estimate the admittance (i.e., the inverse of the desired impedance curve) of the loudspeaker 154 from which the desired parameters can be determined. The adaptive filter 190 receives the control signal u(t) and the varying current signal i(t) across the loudspeaker 154 to generate signal g(n). The signal g(n) generally corresponds to, either directly, or by transformation (e.g., inversion), a desired impedance of the loudspeaker 154. By analysis of the impedance of the loudspeaker 154 (e.g., its magnitude frequency response, its group delay frequency response of the loudspeaker 154, its impulse response, etc.), the controller 150 can determine the parameters of the loudspeaker 154 (e.g. Rdc, fres, Res, Qts, Impedance, etc).

Figure 4B:
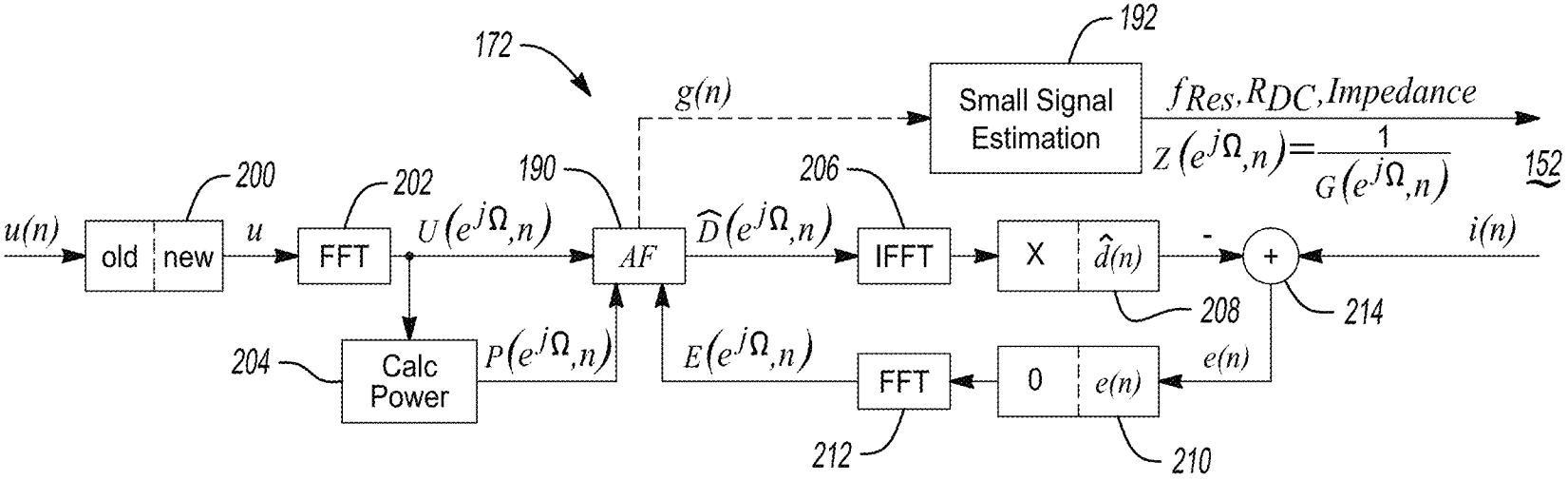
FIG. 4B generally depicts a more detailed implementation of the on-line parameter estimation block of FIG. 4A in accordance to one embodiment.

FIG. 4B depicts a detailed implementation of the on-line parameter estimation block 172 of the controller 152 that includes the adaptive filter 190 and the small signal estimation block 192. The on-line parameter estimation block 172 as illustrated in connection with FIG. 4B may be implemented in the sub-band domain. In particular, the on-line parameter estimation block 172 includes an adaptive filter 190 in a sub-band domain (or frequency domain) in accordance to one embodiment. The on-line parameter estimation block 172 includes an input block 200, a first Fast Fourier Transform (FFT) block 202, a calculation power block 204, an inverse FFT (IFFT) block 206, a first frame block 208, a second frame block 210, a second FFT block 212, and an adder 214.

The first FFT block 202 converts the input signal to the loudspeaker 154 from the time domain into the sub-band domain (or frequency domain) (i.e., u(z) or U ($e^{j\Omega}$, n)) which is provided as an input to the calculation power block 202 and to the adaptive filter 190. The calculation power block 204 calculates a power of the signal u(z) which is transmitted to the adaptive filter 190. In general, a least mean square (LMS) algorithm may be used to control the adaptive filter 190. Thereby, an adaptation step size of the adaptive filter 190 may be normalized by the power of the signal u(z). The second FFT block 210 is configured to convert an error signal e(n) from the time domain into the sub-band domain (or frequency domain (i.e., e(z) or E ($e^{j\Omega}$, n)) which is provided as an input to the adaptive filter 190. The error signal e(n) corresponds to a difference between an output of the adaptive filter 190 and the time varying current signal i(n) from the loudspeaker 154. For example, the adaptive filter 190 provides the signal g(n) in the time domain which is fed to the small signal estimation block 192. Similarly, the adaptive filter 190 generates the signal d(z) (or D ($e^{j\Omega}$, n)). The signal d(z) generally corresponds to an estimate of a given/measured current signal $i_{est}(n)$. The first frame block 208 represents an output frame signal whereby only a last half includes valid signals/values (e.g., if a frame shift of 50% is applied). Similarly, the second frame block 210 also represents an output frame block where the first half is filled with zeros if a frame shift of 50% is applied to avoid disturbing by-products of a cyclic convolution. The IFFT block 206 converts the signal d(z) (or $i_{est}(z)$ which corresponds to an estimated current output from the loudspeaker 154) from the frequency domain into the time domain as signal d(n). The adder 214 subtracts the estimated desired signal d(n) from the varying current signal i(n) of the loudspeaker 154 to generate the error signal e(n). In general, the adaptive filter 190 may be implemented as a multi-rate signal processing framework.

Figure 5:
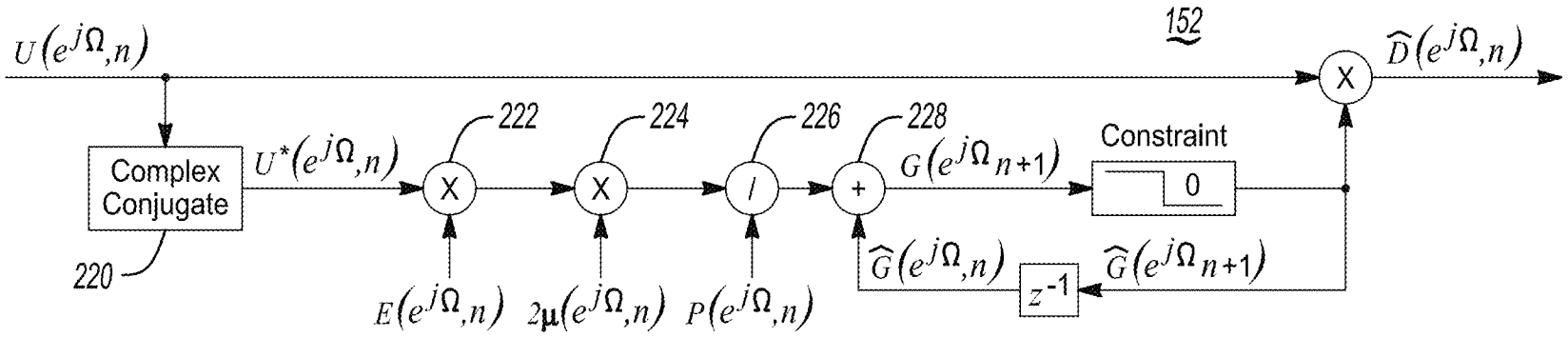
FIG. 5 depicts an adaptive filter employed in the system of FIG. 4B in accordance to one embodiment.

FIG. 5 depicts a detailed implementation of the adaptive filter 190 realized in a frequency domain (FD) in accordance to one embodiment. The adaptive filter 190 may be part of the controller 152 and includes a complex conjugate block 220, a first multiplier circuit 222, a second multiplier circuit 224, a divider circuit 226, an adder circuit 228, and a third multiplier circuit 230. The adaptive filter 190 may utilize a least mean squared (LMS), a recursive least squared (RLS) or any other suitable update scheme. In general, the adaptive filter 190 as illustrated in connection with FIG. 5 illustrates the manner in which a new set of filter coefficients G(z) may be calculated over time. The complex conjugate block 220, the first multiplier circuit 222, the second multiplier circuit 224, the divider circuit 226, the adder circuit 228, and the third multiplier circuit 230 are formed to simulate an equation that provides the signal d(z) that corresponds to the estimate of the given/measured current signal i(n).

The adaptive filter 190 depicts a normalized LMS ("NLMS") based adaptive filter which provides a high degree of flexibility, for example, to realize certain constraints and/or control tasks. In addition, the adaptive filter 190 may represent an effective method (at least in terms of processing power consumption) to realize a general system identification.

In contrast to other system identification tasks, such as for example known from microphone based systems, such as an acoustic echo canceler (AEC), the embodiments herein may not require a demanding adaptive adaptation step-size, as a desired signal, represented by the current signal i(n) (or i(t) in the time domain) and may not include unexpected disturbances (apart from sensor noise) as is the case if using a microphone signal (e.g. knocking at the microphone, blowing into the microphone, speech signals from a near-end talker, etc.) as desired signal. This approach may simplify the adaptive filter. In addition, a residual echo suppressor may not be required to further reduce the error signal, as the current filter coefficient set may be of interest which represents the linear part of the estimated admittance curve.

Adaptation Control

Figure 6A:
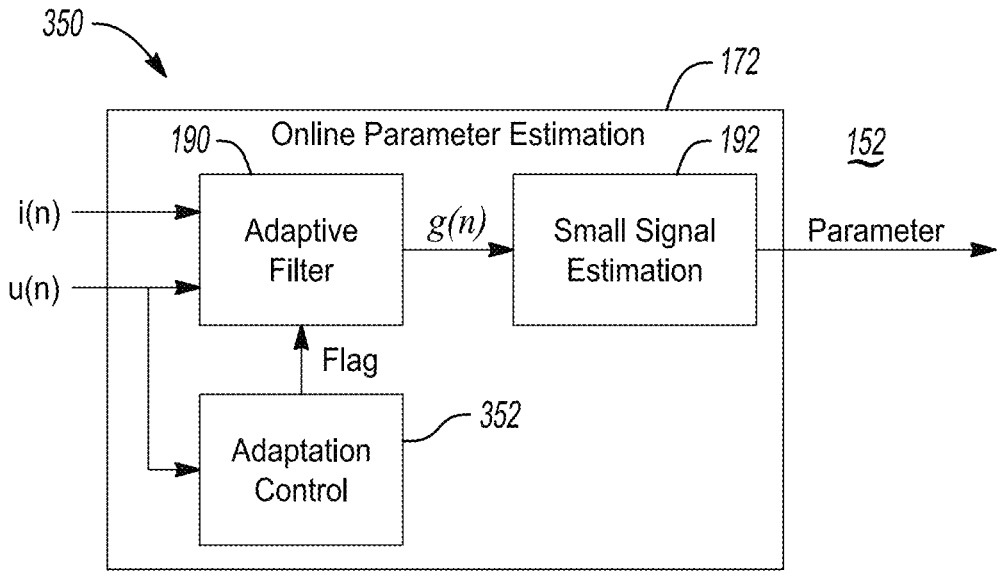
FIG. 6A generally depicts a high-level system for providing a spectral system identifier and adaptive control in accordance to one embodiment.

FIG. 6A generally depicts a high-level system 350 on the controller 152 for providing a spectral system identifier and adaptive control for the on-line parameter estimation block 172 in accordance to one embodiment. The on-line parameter estimation block 172 includes the adaptive filter 190, the small signal estimation block 192, and an adaptive control block 352. The adaptive control block 352 controls the adaptive filter 190 obtain an estimate of the admittance g(n), when the following conditions are met or satisfied:

(i) the driving signal u(t) (or u(n)) exceeds a certain minimum level (e.g., power level of the driving signal u(t) or u(n) exceeds a predetermined minimum level), which is usually set to exceed a given (current) sensor noise by at least a couple of [dB] (e.g. by 1-6 [dB]); and (ii) an input signal spectrum (e.g., spectrum of the varying driving signal u(n) to the loudspeaker 154) includes enough energy at and around the resonance frequency of the loudspeaker 154, otherwise a risk may exist (e.g. by using a narrowband signal, such as a sine tone which frequency is set to off to the resonance frequency of the loudspeaker 154) that the adaptive filter 190 may work, but is unable to deliver a valid curve at and around the resonance frequency of the loudspeaker 154. This aspect may lead to the extraction of invalid parameters which should be avoided. It may be necessary to determine if the driving signal u(n) includes enough energy at the resonance frequency of the loudspeaker 154 since if there is not enough energy with such a signal (i.e., if the signal to noise ratio (SNR) is too low, then a successful adaptation may not be possible (e.g., see (i) above). This condition particularly accounts for the spectral part necessary for the extraction/estimation of the desired small signal parameters (e.g., Rdc, fres, Res, Qts, Impedance, etc.) which is at or around the resonance frequency of the loudspeaker 154. For at least this reason, adaptation is allowed if (a) there is enough energy present and even if enough energy is provided, (b) a minimum amount of energy may be present at or around the estimated resonance frequency of the loudspeaker 154.

The adaptation control block 352 is configured to transmit a flag signal (i.e., Flag) that is set to zero or one. The adaptation control block 352 sets the flag signal to one if the conditions of (i) and (ii) are met. If the flag signal is set to one, then filter coefficients of the adaptive filter 190 are adapted. The flag signal (if set to one) may indicate whether a new set of parameters ((e.g., Rdc, fres, Res, Qts, Impedance, etc.) are to be determined and used or if a previously set of estimated parameters should be used instead. If the flag signal is set to one, then the adaptive filter 190 is adapted to generate a new signal for g(n) which, as noted above, generally corresponds to, either directly, or by transformation (e.g., inversion), a desired impedance of the loudspeaker 154. By analysis of the impedance of the loudspeaker 154 (e.g., its magnitude frequency response, its group delay frequency response of the loudspeaker 154, its impulse response, etc.), the controller 150 can determine new parameters of the loudspeaker 154 (e.g. Rdc, fres, Res, Qts, Impedance, etc.). In this case, the small signal estimation block 192 extracts the parameters $R_{dc}$, $f_{res}$, $R_{es}$, $Q_{ts}$, Impedance, etc. from the new signal g(n) as generated by the adaptive filter 190.

The adaptive filter 190 may be deactivated if the flag signal is set to zero. In this, case, the system 350 delivers a previously determined set of parameters that are based on the previously adapted admittance curve and the loudspeaker parameters that are extracted from such a curve. Thus, in this case the adaptation control may serve as a fail-safe mechanism. Generally speaking, the flag condition controls adaptation of the adaptive filter 190 which indicates whether the currently available signal g(n) from the adaptive filter 190 is valid or not (i.e., if the currently available signal g(n) may be used for current parameter extraction or not. If the adaptive filter 190 cannot be adapted based on the flag signal (e.g., flag signal set to zero), then the small signal estimation block 354 does not update the parameters (i.e., the previously calculated parameters remain frozen and/or a based on an older, previous signal of g(n)).

Figure 6B:
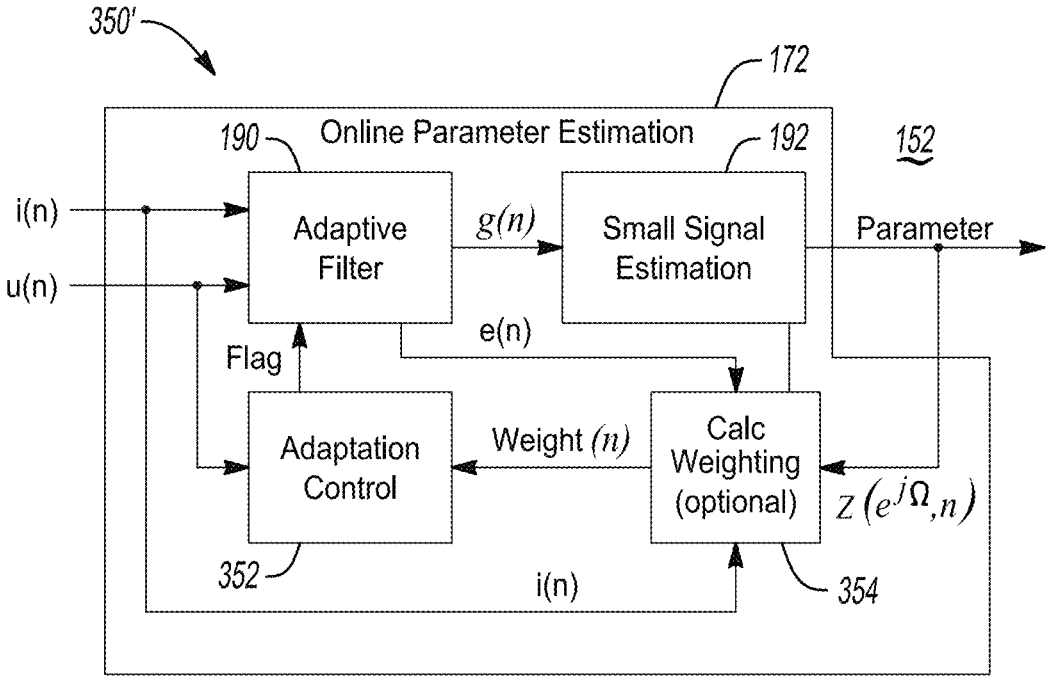
FIG. 6B generally depicts a detailed implementation of the system of FIG. 6A in accordance to one embodiment.

FIG. 6B generally depicts another implementation of the system 350 for providing the spectral system identifier and the adaptive control for the on-line parameter estimation block 172 of the controller 152 in accordance to one embodiment. The system 350 includes the adaptive filter 190, the small signal estimation block 192, the adaption control block 352, and a calculation weighting block 354. The calculation weighting block 354 is configured to provide a weighting function to accentuate the region at or around the resonance frequency of the loudspeaker 154 to eventually allow adaptation of the adaptive filter 190, even if a narrowband signal is present. The system 350 may apply weighting if the adaptation control block 352 has controlled the adaptive filter 190 to modify or adjust the input signal from the loudspeaker 154, i(n) and the signal u(n) at least once.

Figure 6C:
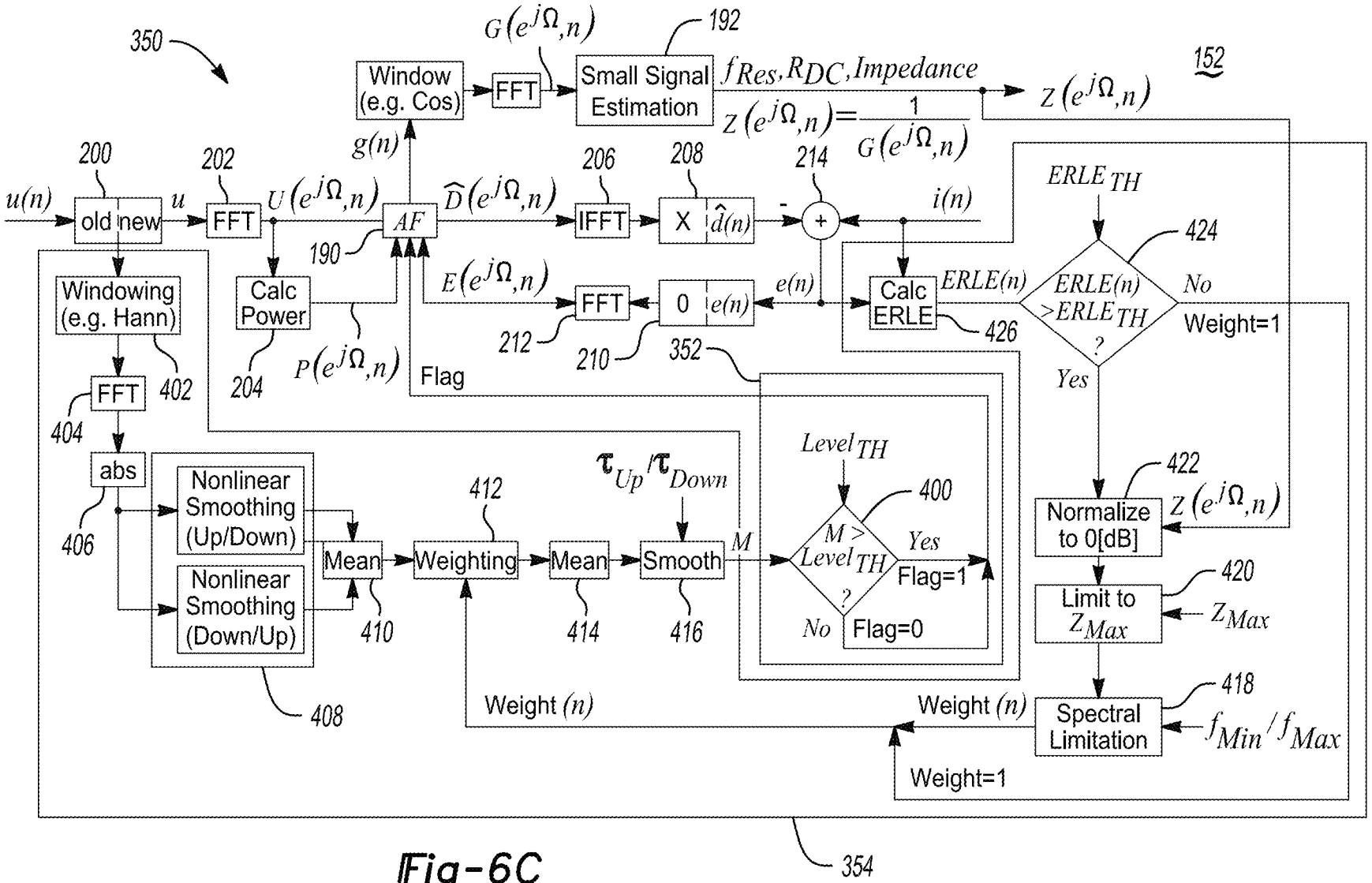
FIG. 6C generally depicts a detailed implementation of the system of FIG. 6B in accordance to one embodiment.

FIG. 6C generally depicts a detailed implementation of the system 350 of FIG. 6B in accordance to one embodiment. The system 350 includes the input block 200, the first FFT block 202, the calculation power block 204, the IFFT block 206, the first block 208, the second block 210, the second FFT block 212, and the adder 214 as set forth in FIG. 4B above. The operations of these features have been set forth above.

Figure 7A:
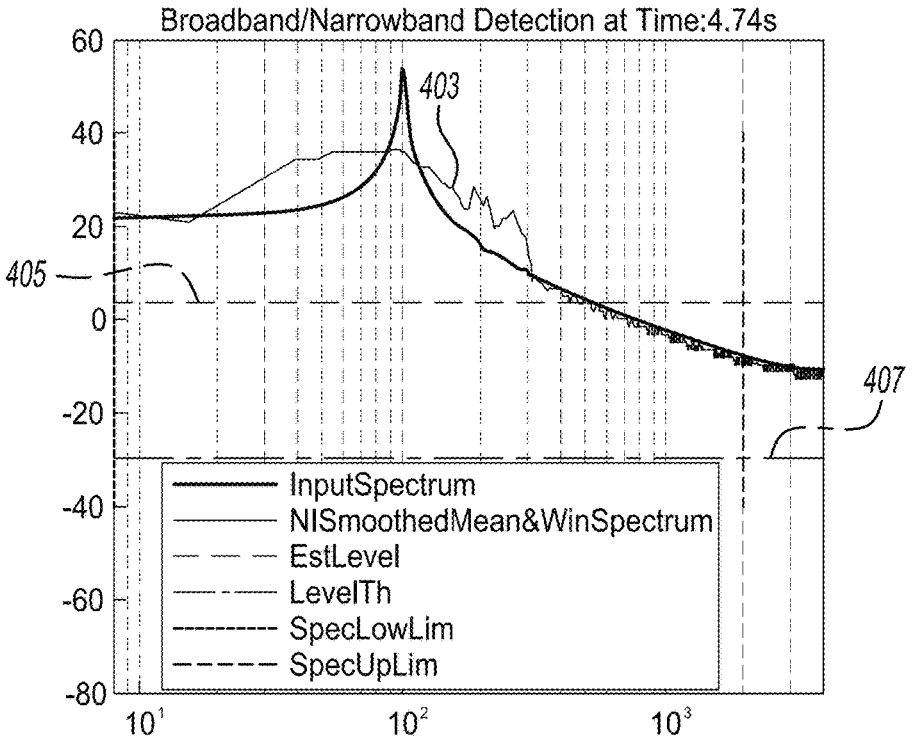
FIGS. 7A-7B depicts a first plot in which windowing on an input block signal was avoided and a second plot in windowing on the input block signal has been applied, respectively.
Figure 7B:
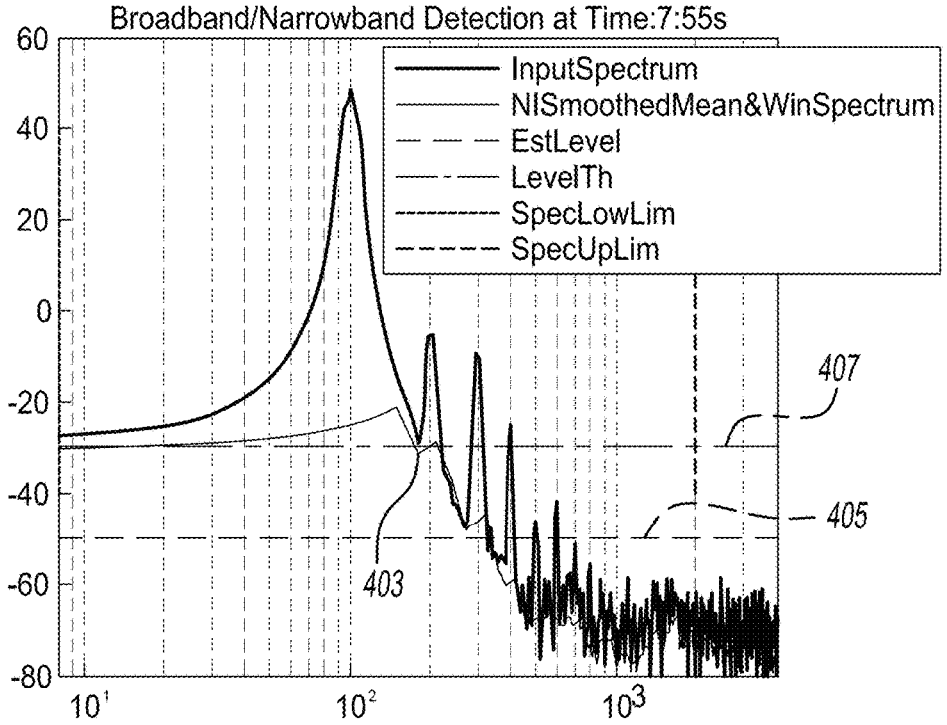

The system 350 also includes the adaptation control block 352 and the calculation weighting block 354. The adaptation control block 352 includes a first determination block 400 that provides the flag signal. The calculation weighting block 354 includes a windowing block 402, a FFT block 404, an absolute value block 406, a first smoothing block 408, a first mean block 410, a weighting block 412, a second mean block 414, a second smoothing block 416, a spectral limitation block 418, a limit block 420, and normalize block 422, a threshold block 424, and a threshold calculation block 426. The windowing block 402 receives the input signal to the loudspeaker, u(n) as generated from the signal processing block 170. The windowing block 402 applies a windowing function (e.g., a Von-Hann (or Hann window)) to u(n) to avoid a picket-fence effect. For example, FIG. 7A generally depicts the picket fence effect of signal u(n) on waveform 403. FIG. 7B illustrates the removal of the picket effect on the signal u(n) 403.

Without the windowing block 402, signal levels of the test tone frequency appear higher than they actually are (e.g., see FIG. 7A), due to the picket-fence effect, but with an applied window (e.g. Von-Hann) this negative effect is gone, and a lobe at the frequency becomes wider (e.g., see FIG. 7B). However, this condition may not adversely affect the system 350. The FFT block 404 converts the driving signal u(n) from the time domain into the frequency domain. The absolute value block 406 takes the absolute value of the signal u(z) which is then fed to the first smoothing block 408. The first smoothing block 408 performs both non-linear smoothing from high frequencies to low frequencies (e.g., "Up/Down") and non-linear smoothing from low frequencies to high frequencies (e.g., "Down/Up"). In other words, the first smoothing block 408 performs the smoothing operation twice. The smoothing is generally performed in parallel. In general, the first smoothing block 408 performs nonlinear smoothing of a power spectral density (PSD) of the signal u(z) when the absolute value block 406 takes the absolute value of the signal u(z). For example, by taking the absolute value of the complex spectrum of the signal u(z), this condition enables the first smoothing block 408 to perform nonlinear smoothing of the PSD.

The first mean block 410 obtains the mean of both of the smoothed versions of the signal u(z). In this case, the spectral bias of the non-linearly smoothed signals may be successfully avoided. For example, waveform 403 in FIG. 7B also illustrates the spectral bias of the non-linearly smoothed signal. In this case, it can be seen, the energy of the sine tone at, for example, 100 Hz may almost be completely removed from the spectrum. Hence, the system 350 may cause the adaptation to be immune against narrowband signals, as the adaptation may deliver valid values at this frequency where the SNR is high enough to allow convergence, but this may not necessarily be in alignment with the resonance frequency of the loudspeaker 154.

In general, weighting may be performed by the system 350 once the system 350 has been successfully adapted (e.g., adaptive filter 190 is activated in response to flag signal being set and small signal estimation block 192 determines new parameters ((e.g. $R_{dc}$, $f_{res}$, $R_{es}$, $Q_{ts}$, Impedance. etc.)). The weighing may be determined as follows: the threshold calculation block 426 receives the varying current signal from the loudspeaker 154 i(n) and calculates a current error return loss enhancement signal (ERLE(n)). Despite the fact, that the ERLE(n) in FIG. 6C is determined in the time domain, it is recognized that the ERLE(n) may also/alternatively be calculated in the frequency domain. In this case, the error signal e(z), resp. E(e^jw,n) as already available, together with a frequency domain transformed version of the current time signal i(n), i.e. i(z), may be used for this purpose, as well. The current error return loss enhancement signal generally corresponds to a ratio between the desired current that is to be provided to the loudspeaker 154 and an error. For example, the ratio between the current signal i(n) and the error signal e(n) serves as an indicator of how well the adaptive filter 190 as already covered, which is represented by the most recent ERLE(n) measurement. If the current error return loss enhancement signal (ERLE(n)) exceeds a threshold value, $ERLE_{TH}$, then the threshold block 424 activates the normalize block 422 to utilize the currently existing impedance curve (e.g., Impedance) as provided by the small signal estimation block 192 for a basis to determine a weighting function (Weight (n)).

To obtain the desired amount of weighting from the impedance curve, the normalize block 422 may first obtain the absolute value of the impedance curve, the normalize block 422 may then set the lower bound of an absolute value to a normalized value to 0 dB.

The limit block 420 limits the normalized value to a tuneable, maximum value. After this, the spectral limitation block 418 limits the spectral regions of the tuneable, maximum value of below a certain, tuneable lower frequency and above a certain, tuneable upper frequency ($f_{Max}$) may be set to 1 (0 [dB]) (i.e. to a neutral value). The spectral limitation block 418 may ensure that it is possible to avoid those spectral regions that may be overly accentuated by the corresponding trajectory of the impedance curve, acting as weighting function. Hence, the purpose of the weighting is to accentuate the region at and around the resonance frequency of the loudspeaker 54 to eventually allow adaptation via the adaptation block 352 and the adaptive filter 190, even if a narrowband signal is present. This may be performed if the narrowband signal includes sufficient energy at the desired spectral region (e.g. at and around the resonance frequency of the loudspeaker 154), which will be known once the system 350 has successfully been adapted (e.g., which itself is the case if the current ERLE measurement (ERLE(n)) exceeds the given threshold $ERLE_{TH}$.

Figure 8:
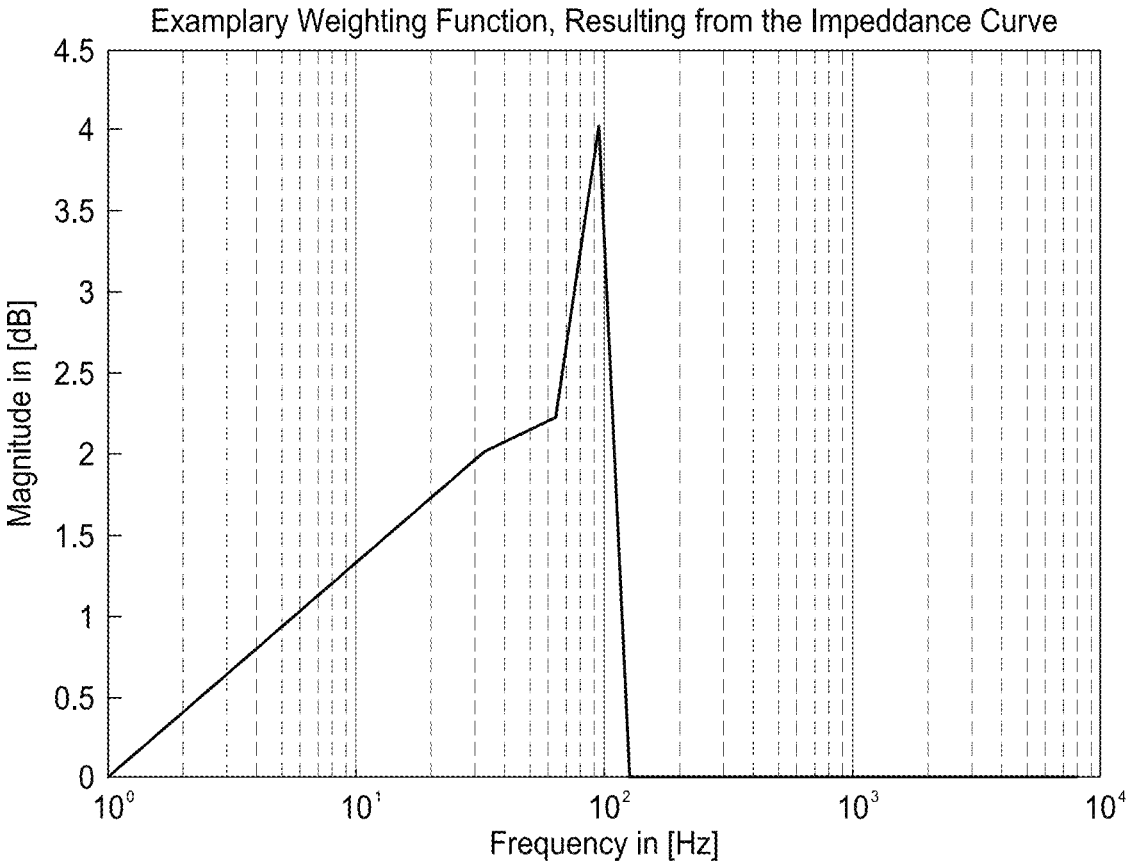
FIG. 8 generally depicts an example weighting function that is based on an impedance curve of the loudspeaker.

FIG. 8 generally depicts an example weighting function that is generated based on an impedance curve of the loudspeaker 154. For example, FIG. 8 generally illustrates an accentuation of the region at or around the resonance frequency of 100 Hz which corresponds to the resonant frequency of the loudspeaker 154. As shown, frequencies that are greater than 100 HZ are removed and not considered for the weighting.

Referring back to FIG. 6C, the second mean block 412 obtains the mean over frequency to obtain a single energy value after the weighting block 412 is activated to apply the weighting function (Weight (n)). The single energy level may be successively smoothed by, for example, a time domain—Infinite Impulse Response (IIR) smoothing filter (or the second smoothing block 416) with a separately adjustable up time constant, $\tau_{Up}$ and a separately adjustable down time constant $\tau_{Down}$. Since the second mean block 414 calculates the mean over frequency, a single value, which varies over time remains, this value is then smoothed by the smoothing filter 416. The attack time may be typically shorter as the decay time constant to avoid unnecessary freezing of the adaptation once a broadband signal with sufficient energy is present. The broadband signal with sufficient energy is generally illustrated as 405 in FIGS. 7A and 7B. The first determination block 400 compares the smoothed energy value of the signal u(z) (e.g., as output from the second smoothing block 416 or (e.g., signal M as illustrated in FIG. 6C)) to an adjustable threshold $Level_{TH}$ which is represented as 407 in FIGS. 7A and 7B. If the smoothed energy level of the signal u(z) is greater than the adjustable threshold, $Level_{TH}$, then the first determination block 400 sets the flag signal to one to activate the adaptive filter 190. As stated above, if the flag signal is set to one, this condition indicates that small signal estimation block 192 is to determine new parameters ((e.g. $R_{dc}$, $f_{res}$, $R_{es}$, $Q_{ts}$, and Impedance)). If the flag signal is set to zero (e.g., the smoothed energy level of the signal u(z) is less than the adjustable threshold, $Level_{TH}$, this condition indicates that previously determined parameters as established by the small signal estimation block 192 is to be used. As noted above, an optional weighting function may be performed prior to the adaptive filter 190 being activated. Thus, in this case, the weighing block 412 may be employed to perform the weighting along with the spectral limitation block 418, the limit block 420, the normalize block 422, the threshold block 424, and the threshold calculation block 426.

Referring back to the condition at the threshold block 424 with respect to the current error return loss enhancement signal (ERLE(n)) being less than the threshold value, $ERLE_{TH}$. This condition corresponds to the system 350 starting up for the first time with no previously stored admittance/impedance curve g(n) being available. Therefore, it may be assumed that the adaptive filter 190 (and the adaptation control block 352) is blind. Thus, the system 350 has no information on the impedance (i.e., this condition also implies that there is no estimate related to the resonance frequency of the loudspeaker 154). In this case, the threshold block 424 sets the weighting function equal to one and the weighting is initialized by ones which will not block the adaptation of the adaptive filter 190. In general, the threshold block 424 may not be view as simply indirectly influencing the adaption control (e.g., the adaptive filter 190) by setting the signal FLAG signal (or setting the weighting to 1) if ERLE(n) is less than $ERLE_{TH}$. This is necessary since the weighting is not the only criteria which influences setting the signal FLAG (or setting the flag signal). Additional or independent criteria may also be considered such as the total, current SNR of the input signal (u(z)) which is checked or assessed at the first determination block 400. This condition demonstrates that even if the weighting is set to one via the threshold block 424, the flag may still become one or zero, depending on the current SNR of the input signal u(n) (i.e., or the smoothed output from the second smoothing block 416 or (e.g., signal M) is greater or less than the $Level_{TH}$.

Once the system 350 has been sufficiently well estimated by the adaptive filter 190 after startup (e.g., after the weighting function has been set to one or initialized as described above) and the SNR of the input signal u(z)) (e.g. output of block 416) is above the threshold, $Level_{TH}$ for a sufficient duration of time, the system 350 operates as expected. For example, once the unknown system 350 has been sufficiently well estimated by the adaptive filter coefficient set g(n), which is the case once the $ERLE_n$ measure exceeds the given threshold $ERLE_{TH}$, the currently estimated admittance/impedance curve g(n) can be used to generate the weighting function "Weight(n)" which will influence the signal FLAG and thereby controlling the adaptation of the adaptive system. In general, once a valid version of the admittance/impedance is estimated by g(n), the adaptation, as controlled by the signal FLAG will take place and this valid set will not be destroyed overtime by blocking adaptation if there is not enough SNR available at or around the resonance frequency of the loudspeaker 154.

Robustness Enhancement of the Parameter Extraction

Once the system 350 employs the adaptation control (i.e., the adaptation is more or less fail-safe), it is possible to extract the parameters from coefficients of the adaptive filter 190 that represent the admittance (e.g., by taking the inverse of the impedance curve).

In general, and as stated above, one of the loudspeaker parameters of interest is the resonance frequency $f_{Res}$. As also noted above, the resonance frequency $f_{Res}$ may be extracted neither from the admittance, nor from the impedance curve (which is general may be possible), but, due to robustness reasons, from the group delay frequency response of the impedance curve, utilizing, for example, the Smith-method for the group delay frequency response calculation.

Another loudspeaker parameter of interest may be the DC resistance, $R_{DC}$. The online parameter estimation block 170 (or the small signal estimation block 192) may determine the the DC resistance, $R_{DC}$. This value may be extracted from the impedance curve by searching for a minimum below the resonance frequency. In some cases, such a determination may be erroneous, mostly because the estimated curves do not represent the real trajectory, since often, the input audio signal may not include enough energy at those very low spectral regions. For this reason, the online parameter estimation block 170 (or the small signal estimation block 192) may search for a $2^{nd}$ minimum of the impedance curve, which resides above the resonance frequency of the loudspeaker 154. In this region, there may be enough energy to estimate the impedance curve well.

Due to a high sensor noise attributed to a current sensor (not shown) that measures the varying current signal i(t) from the loudspeaker 154, the estimated admittance and as such also the derived impedance curve may appear to be often very noisy at high frequencies. The reason may be that typically an input signal (e.g., input audio signal x(t) or any other typical playback signal) does not include sufficient energy at higher frequencies, but the sensor noise (e.g., current sensor noise) is almost white, hence the signal to noise ratio (SNR) at those upper frequency regions may not be preferred, which inevitably leads to disturbances in the adaptation. If the noise becomes too large, the impedance curve may also become too noisy, which may lead to erroneous parameter extractions, since then often high peaks, due to a noisy trajectory can be misinterpreted as the resonance frequency of the loudspeaker. To securely avoid such misinterpretations, the admittance, and consequently the impedance curve should be non-linearly smoothed, using, for example, octave smoothing. In this case, higher spectral regions may be smoothed while lower spectral regions are softly smoothed. This may be ideal since the resonance frequency of a loudspeaker 154 typically resides at low frequencies and as such, the resonance frequency value of the loudspeaker 154 may not be negatively influenced by the smoothing.

Spectral Compressor

As noted above, the manner to robustly extract certain parameters from an unknown loudspeaker (e.g., the loudspeaker 154) can be extracted in an adaptive manner. Further, the manner in which such parameters securely protect the loudspeaker 154 enable an improved usage of its physical capabilities. One aspect of the disclosed system may be to securely protect the loudspeaker 154. Optimization may be achieved by the utilization of the MBL.

Figure 9:
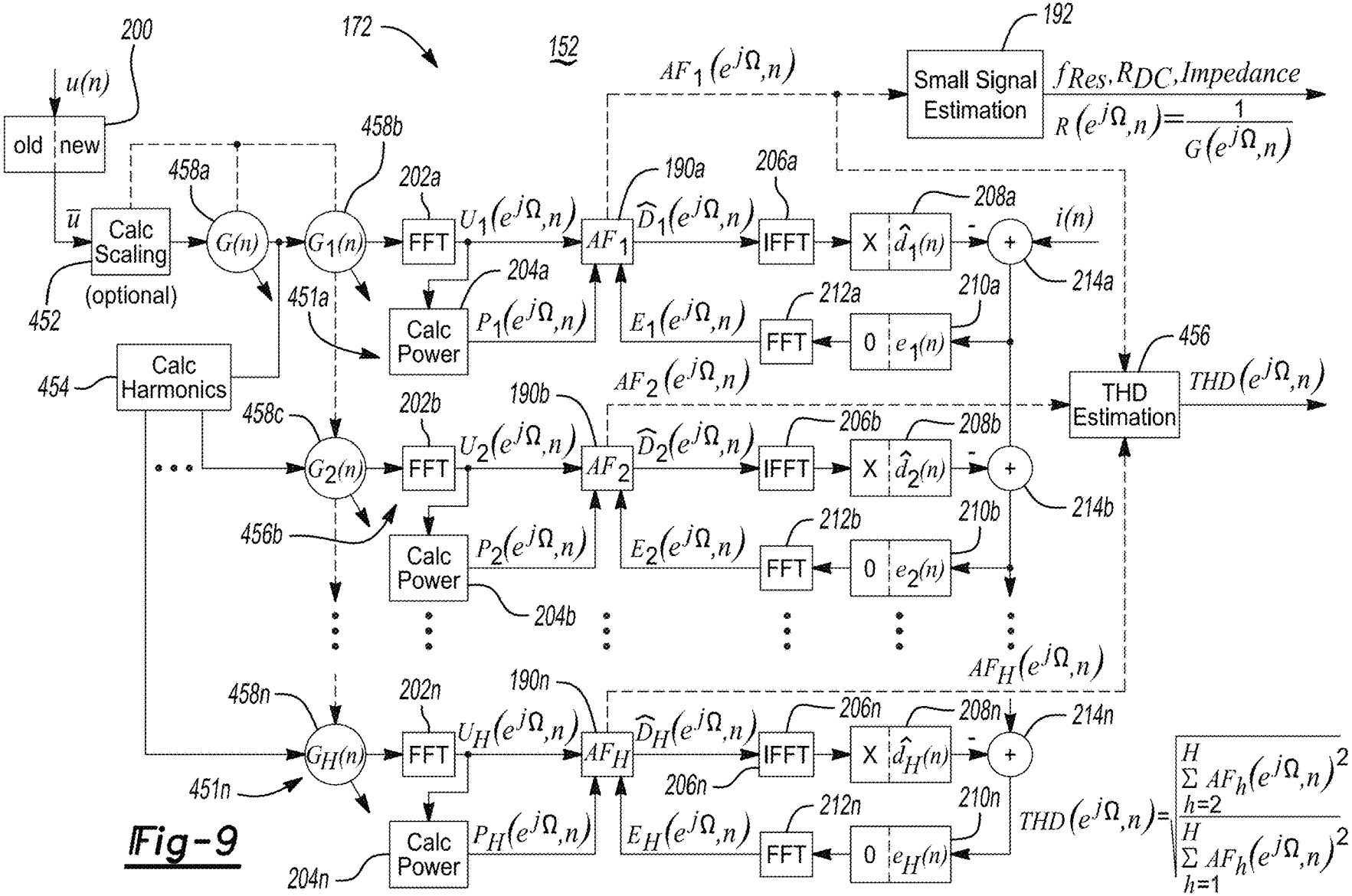
FIG. 9 generally depicts another implementation of an online parameters estimation block in a spectral domain to provide an estimation of a total harmonic distortion (THD) in accordance to one embodiment.

One advantage of the MBL is that the MBL may limit different spectral regions separately and not in a broadband manner such as a conventional limiter, and/or a dynamic compressor. The benefit of splitting the spectrum into separate regions and limiting those individually may be that certain areas of the spectrum, which is usually given by its lower spectral part, statistically tend to overdrive the loudspeaker 154 more often as mid or higher spectral parts. Hence, it may not be necessary to compress the complete, broadband signal if the time signal exceeds a certain threshold, but to limit this part of the spectrum of the input signal which actually tends to overdrive the loudspeaker 154. This may lead to disturbing acoustical artifacts which should be avoided. By correct tuning of the MBL, the performance of a loudspeaker 154 can be optimized, since, from a subjective (psychoacoustical) point of view, certain harmonic distortions may not create disturbing acoustical artifacts and thus are allowed to remain in the output signal, which eventually leads to a better performance at low frequencies. Rather, this aspect may enable the manner in which the THD can be estimated in an adaptive manner as depicted in FIG.9. Also, this aspect may enable the loudspeaker 154 to sound better as if the loudspeaker 154 purely operates in its linear limits. The automation of the adjustment of a spectral compressor, to which, the MBL belongs by taking psychoacoustic principles into account will be described in more detail below.

Estimation of Nonlinear Distortions

FIG. 9 generally depicts another implementation of the online parameter estimation block 172 on the controller 152 including a plurality of the adaptive filters 190*a*-190*n* in a spectral domain to provide an estimation of a total harmonic distortion (THD) in accordance to one embodiment. The online parameter estimation block 172 as shown in FIG. 9 is generally similar to the online parameter estimation block 172 as illustrated in FIG. 4B. However, the online parameter estimation block 172 as illustrated in FIG. 9 includes a plurality of stages 451*a*-451*n*. The stages 451*a*-45*n* include a plurality of the first FFT blocks 202*a*-202*n*, a plurality of the calculation power blocks 204*a* -204*n*, a plurality of the IFFT blocks 206*a*-206*n*, a plurality of the first blocks 208*a*-208*n*, a plurality of the second blocks 210*a*-210*n*, a plurality of the second FFT blocks 212*a*-212*b*, and a plurality of the adders 214*a*-214*n*. FIG. 9 generally illustrates a more generally form of the online parameter estimation block 172 which is enlarged by an estimated (spectral) THD. The estimated (spectral) THD then acts as an input for a calculation of a spectral compressor that is not part of FIG. 9. In general, the online parameter estimation block 172 may provide an estimate of current nonlinear distortion, provided by, for example, a total harmonic distortion (THD) measure, an inter-modulation distortion (IMD) measure (or the nonlinear fingerprint (NLF)), which includes all distortions of the loudspeaker 154, not just caused by harmonic parts, and so on, which then acts as an input for a calculation of a spectral compressor.

The online parameter estimation block 172 further includes a calculation scaling block 452, a calculation harmonics block 454, a THD estimation block 456, and a plurality of time-variable gain values 458*a*-458*n*. The gain values 458*a*-458*n* may reflect a special/simplified form of filters (e.g., gain values) that may vary over time. The online parameters estimation block 172 may increase a signal processing effort (e.g., machine instructions per/second (MIPS) and memory consumption) since for every desired higher harmonic, a separate adaptive filter stage 190 may be necessary. Even if a second and third harmonic (K2 and K3), which may be the most dominant harmonics of the loudspeaker 154, may be taken into consideration, the effort may at least be tripled, when compared, for example, to an ordinary adaptive filter or to estimating the first harmonic of a linear system.

The online parameter estimation block 172 may determine the THD for the loudspeaker 154 in the following manner. The calculation scaling block 452, which may be optional, may scale the driving signal (or incoming audio signal), u(n) which is then fed to the filter 458*a*. As noted above, the calculation scaling block 452 is optional. If the block 452 is not implemented, then the gain values 458*a*-458*n* are not necessary. However, if scaling is applied, then the gain values 458*a*-458*n* are necessary to correct scaling. In general, the calculation scaling block 452 may increase performance and ensure that the system is robust to different kinds of input signals that are unknown to the system. The variable gain value 458*a* provides a filtered scaled voltage of the signal u(n) to the calculation harmonics block 454. The calculation harmonics block 454 provides an output to each of the gain values 458*b* and 458*n*. In general, the adaptive filters 190*a*-190 are each similar to the adaptive filter 190 as noted above. However, different reference signals (e.g., $u_1(z)$-$u_n(z)$) are used as inputs so the adaptive filters 190*a*-190*n*, respectively. The harmonic calculation block 454 generates the reference signals $u_1(z)$-$u_n(z)$ after transforming the input signal u(n) into corresponding higher harmonic signals by utililizing trigonometric functions to obtain the desired higher harmonic versions of u(n) (e.g., u2(w)=u(2*w), u3(w)=u(3*w), . . . , un(w)=U(n*w).

The THD estimation block 456 calculates the THD of the loudspeaker 154 based on the following equation:

$$THD(e^{j\Omega}, n) = \sqrt{\frac{\sum_{h=2}^{H} AF_h(e^{j\Omega}, n)^2}{\sum_{h=1}^{H} AF_h(e^{j\Omega}, n)^2}}$$

In other words, the THD estimation block 456 divides the sum of the squared outputs from the adaptive filters 190*b*-190*n* by the sum of the squared outputs from the adaptive filters 190*a*-190*n* to provide a first value. The THD estimation block 456 takes the square root of first value to provide the THD.

Figure 10:
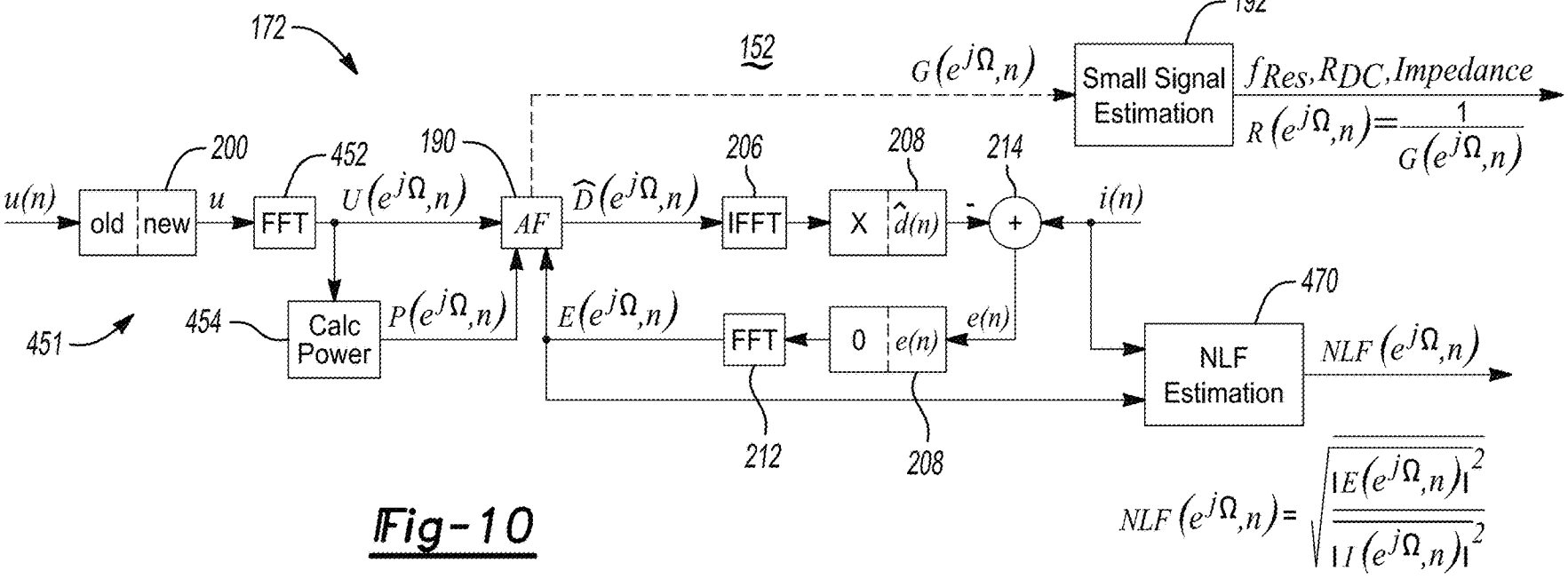
FIG. 10 generally depicts another implementation of an online parameters estimation block in a spectral domain to provide an estimation of a non-linear fingerprint (NLF) in accordance to one embodiment.

FIG. 10 generally depicts another implementation of an online parameters estimation block 172 on the controller 152 in a spectral domain to provide an estimation of the NLF in accordance to one embodiment. The online parameter estimation block 172 is generally similar to the online parameter estimation block 172 as illustrated in FIG. 4B. However, the online parameter estimation block 172 as illustrated in FIG. 9 includes a single stage 451 and a NLF estimation block 470. The online parameters estimation block 172 can determine the NLF based on the driving signal u(n) and the varying current signal from the loudspeaker 154, i(n), as an error signal of the adaptive filter 190 generally estimates a linear part and a sum of all non-linear by-products of the loudspeaker 154.

The NLF estimation block 470 calculates the NLF based on the following equation:

$$NLF(e^{j\Omega}, n) = \sqrt{\frac{|E(e^{j\Omega}, n)|^2}{|I(e^{j\Omega}, n)|^2}}$$

In other words, the NLF estimation block 470 divides the squared error signal (e.g. E ($e^{J\Omega}$, n)) that is output by the FFT block 212 by the varying current signal from the loudspeaker (e.g. I ($e^{J\Omega}$, n)) to provide a first value. The NLF estimation block 470 takes the square root of the first value to provide the NLF. For example, the NLF estimation block 470 takes the square root of the ratio of the squared error signal and the squared current signal from the loudspeaker 154 to obtain the NLF. In general, the NLF estimation block 470 may calculate the NLF based on the varying current signal i(n) and the spectral error signal E($e^{JW}$, n). The formula indicates a calculation in the spectral domain, while not shown in FIG. 10, this entails that i(n) has to be transformed into the spectral domain by the NLF estimation block 470.

Figure 11:
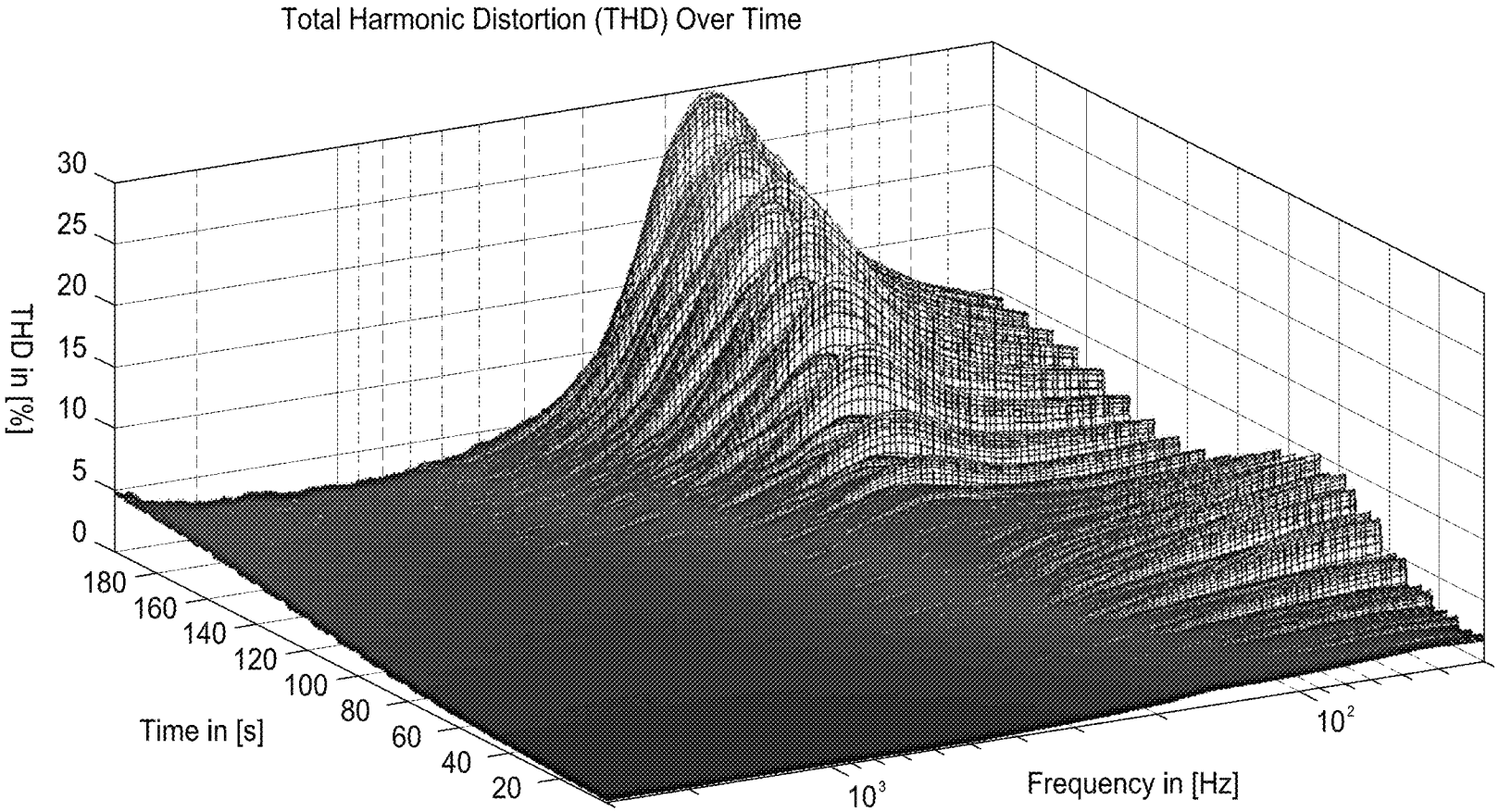
FIG. 11 generally depicts a three-dimensional plot of a total harmonic distortion (THD) in accordance to one embodiment.

The NLF may be interpreted as spectral dependent distortion measure that provides a value of between 0 and 1 (or 0% and 100%). Typically, most non-linear distortions may appear at low frequencies and at around the resonance frequency of the loudspeaker 154 as generally shown in connection with FIG. 11. FIG. 11 generally illustrates a three-dimensional plot of a spectral dependent THD over time based on measurements of a loudspeaker that is driven with pink noise with via a gradually increasing volume over time. Based on the features as discussed for at least FIGS. 9 and 10, it can be seen that it is possible to continuously estimate the spectral dependent non-linearities of an unknown loudspeaker (e.g., the loudspeaker 154) such as the THD and/or the NLF.

Calculation of an Equalizing Filter for a Spectral Compressor

Figure 12:
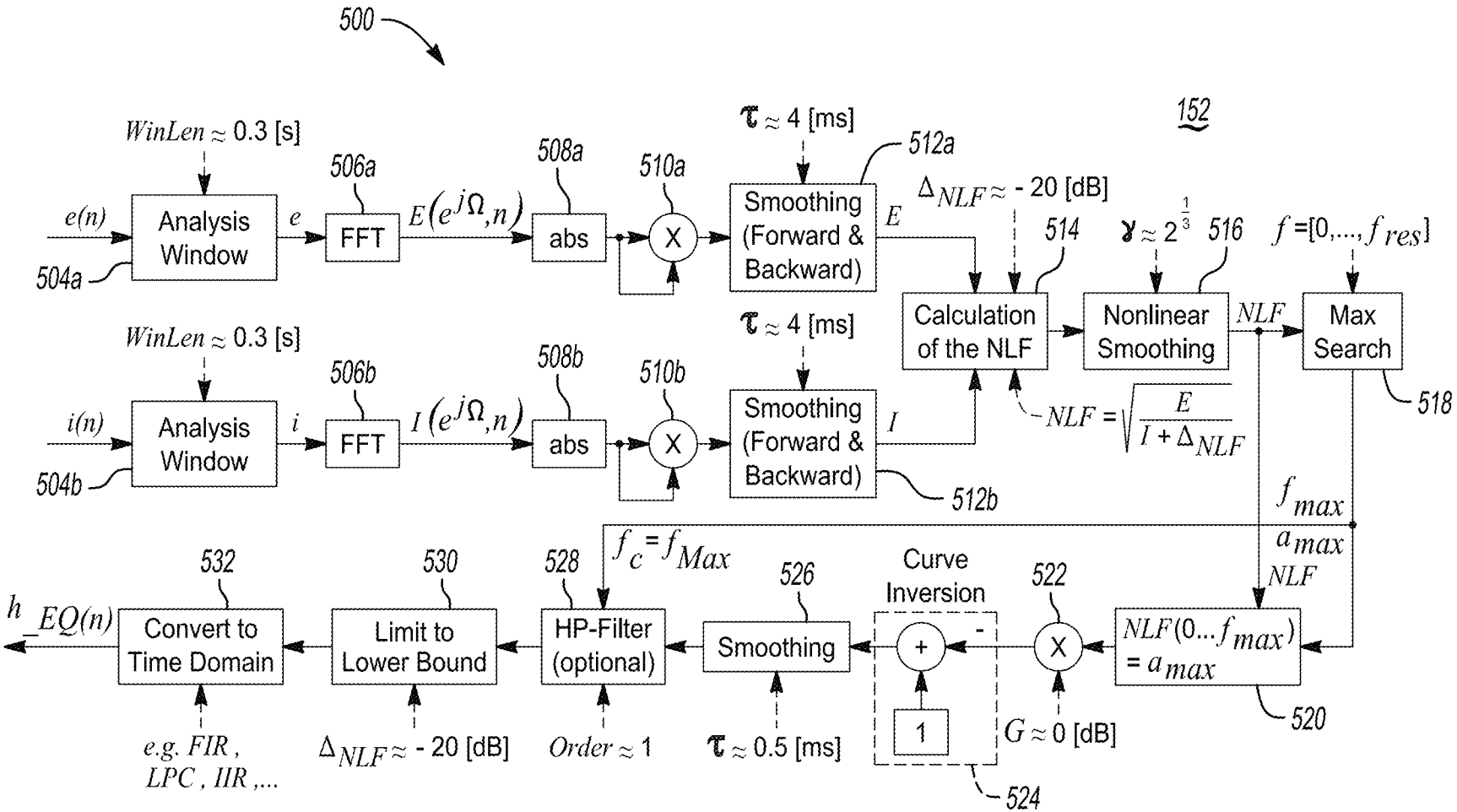
FIG. 12 generally depicts a system for determining an equalizing filter for a spectral compressor in accordance to one embodiment.
Figure 15:
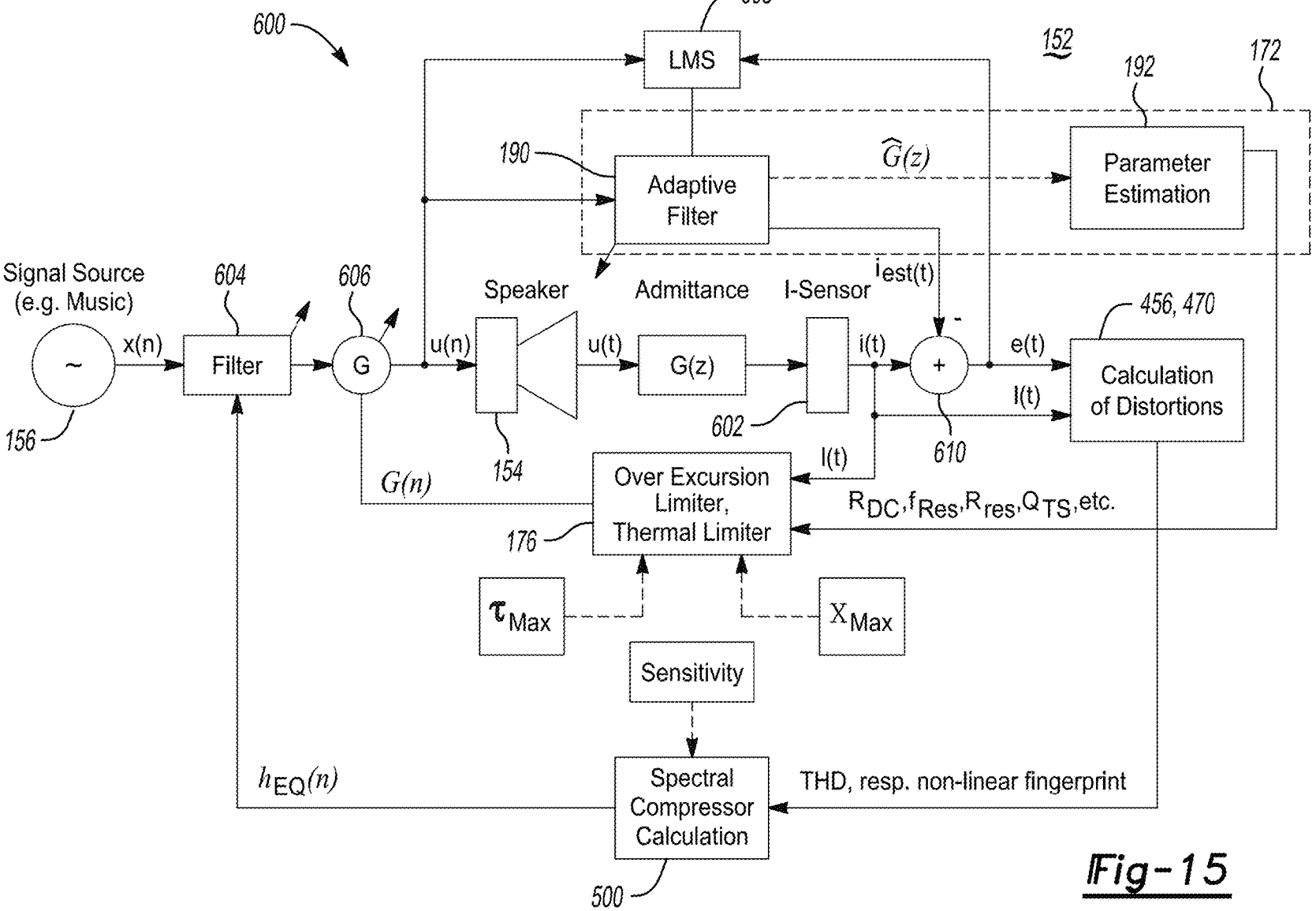
FIG. 15 generally depicts a system with a spectral compressor in accordance to one embodiment.

Upon determining the THD and/or the NLF for the loudspeaker 154 which generally correspond to spectral dependent non-linearities of the loudspeaker 154, aspects related to the spectral compressor may be ascertained such as for example spectral weighting or an equalizing (EQ) filter. The following section discloses aspects related to a spectral compressor, which may correspond to the spectral weighting of the equalizing (EQ) filter. FIG. 12 generally depicts a system 500 (or spectral compressor 500) on the controller 152 that may be used to determine a desired EQ-filter based on a signal $h_{EQ}$(n), the error signal e(n) and the current signal i(n). The signal $h_{eq}$(n) generally corresponds to filters coefficients irrespective for an ITR or FIR filter which are applied to the EQ filter 604 as illustrated in FIG. 15.

Referring back to FIG. 12, the spectral compressor 500 includes first and second analysis window blocks 504*a*-504*b*, first and second FFT blocks 506*a*-506*b*, first and second absolute value blocks 508*a*-508*b*, first and second multiplier blocks 510*a*-510*b*, first and second smoothing blocks 512*a*-512*b*, an NLF calculation block 514, a nonlinear smoothing block 516, a maximum value search block 518, a first replacement block 520, a third multiplier block 522, a curve inversion block 524, a smoothing block 526, an optional HP-filter 528, a limit block 530, and a domain conversion block 532. In operation, the error signal e(n) is fed to the first analysis window block 504*a* and the varying current signal from the loudspeaker 154, i(n) is fed to the second analysis window block 504*b*. Each of the first and the second analysis window blocks 504*a*, 504*b* applies a window (e.g., a 300 ms long rectangular window) to the error signal e(n) and the current signal i(n), respectively. The first FFT block 506*a* and the second FFT block 506*b* converts the error signal e(n) and the current signal i(n) into frequency (or spectral) domain signals e(z) (or E ($e^{J\Omega}$, n)) and i(z) (or I ($e^{J\Omega}$, n)). The first and the second absolute value blocks 506*a*, 506*b*, respectively, takes the absolute value of the signals e(z) and i(z) and the first and second multiplier blocks 510*a*, 510*b* square the signals e(z) and i(z) to calculate the power spectral densities (PSD).

The first and second smoothing blocks 512*a* and 512*b* may then smooth the signals e(z) and i(z) using, for example, an infinite impulse response (IIR) smoothing filter that is applied from low to higher frequencies to provide two smoothed spectra $\bar{E}$ and $\bar{I}$. At that point, in a serial fashion, from high to low frequencies, to avoid spectral bias and based on those two smoothed spectra $\bar{E}$ and $\bar{I}$, the NLF calculation block 514 calculates the NLF of the loudspeaker 154 considering a small value $\Delta_{NLF}$ to avoid divisions by zero. After this, the non-linear smoothing block 516 smooths the NLF by smoothed utilizing a nonlinear smoothing filter which delivers a maximum of NLF (or max (NLF)) in a non-linear smoothed form within a lower spectral range. The maximum of NLF is transmitted to the limit block 520. The maximum of NLF may provide a maximum within a lower spectral range to a resonance frequency of the loudspeaker 154 ($f_{res}$).

The maximum value search block 518 determines the maximum frequency (e.g., $f_{max}$) as well as its corresponding amplitude value $\alpha_{max}$. The first replacement block 520 replaces the NLF from 0 to $f_{max}$ with the value $\alpha_{max}$. With the tuning parameter G, the third multiplier block 522 scales the modified NLF signal. Thus, the smaller the tuning parameter G, the higher the achievable bass will be, but also, as a consequence, remaining non-linearities and as such potentially also the perceivable and annoying acoustical artifacts may exist.

The curve inversion block 524 inverts the scaled NLF by subtracting the scaled NFL from one. At this point, the curve is one or at least close to one at spectral areas where little to no nonlinear distortions occur, and below the neutral value of one at frequencies where the loudspeaker 154 may show non-negligible nonlinear distortions. This curve, which depicts a first version of the desired magnitude response of the EQ filter, may next be smoothed by the smoothing block 526. The smoothing block 526 may be an ordinary $1^{st}$ order IIR filter. The optional filter 528 may be a high pass filter and may include an adjustable slope at low frequencies and that may be applied having a gradient of, for example, 6 [dB/Octave]. By doing this, the perceivable bass performance may be reduced, but at the same time, Acoustic Echo Cancellation (AEC) performance may be increased by a couple of dB. In general, the HP-filter 528 may provide a slope of 0 [dB/Octave] (e.g., flat line, i.e., when the HP-filter 526 is not active) may be applied to obtain as much bass from the loudspeaker 154 as possible. However, for other applications, where, for example, the AEC performance needs to be improved, the filter 528 provides an option for achieving this aspect.

In the following, additional acoustic performance may be in focus and it is desired to enhance this aspect to the fullest extent possible. Thus, in this case, the filter 528 may be removed and a slope of 0 [dB/Octave] is applied. Next, the curve may be limited to an adjustable, lower bound via the limit block 530, to avoid that certain spectral areas are heavily reduced by the EQ-filter. The lower bound applied by the limit block 530 may be provided as $\Delta_{NLF}$, however it is recognized that a different tuning parameter may be used. Finally, the spectral EQ-filter may be transformed from the spectral or frequency domain into the time domain via the domain conversion block 532. Therefore, different options may be possible.

It is recognized that different options may be possible. For example, one embodiment may include generating an ordinary finite impulse response (FIR) filter with a certain length, such as by using a frequency sampling method to obtain a linear phase FIR filter or a more efficient minimum-phase version of the linear phase FIR filter. In this regard, it should be noted that due to the fact that the EQ-filter may naturally reduce levels especially at low frequencies, at or around the resonance frequency of the loudspeaker 154. The FIR filter may have a certain minimum length, otherwise the achieved, spectral resolution of the FIR filter may inevitably be too coarse and not desired. The implementation of a long FIR filter may be expensive. Thus, it may be preferable to approximate the desired, spectral trajectory of the EQ-filter with a linear prediction coding (LPC) filter, which may be efficiently realized with a short FIR filter in a feedback-loop. Another option may also include realizing the desired EQ-filter by IIR filter, but an estimation of an arbitrary, desired trajectory by IIR filter may be expensive. Tests showed, that the LPC version may be the most efficient, in terms of filter length, but also in terms of calculation effort of the LPC filter coefficients. In general, a desired, arbitrary EQ-filter may be realized with half of the coefficients of a minimum-phase FIR filter and about a quarter of the coefficients of a linear-phase FIR filter. There may also be applications in which a linear-phase FIR-filter may have to be used, for example, if the phase of the overall acoustical system, which also includes the time varying, spectral compressor 500 (or control signal $h_{EQ}(n)$) is not allowed to change over time to avoid undesired acoustical modifications, such as dynamic changes in the localization, the auditory source width, the listener's envelopment and so on, which are all coupled to the overall phase and its stability over time. As an alternative, constant phase (IIR) filters may be used as well, as a more effective filtering version.

Figure 13:
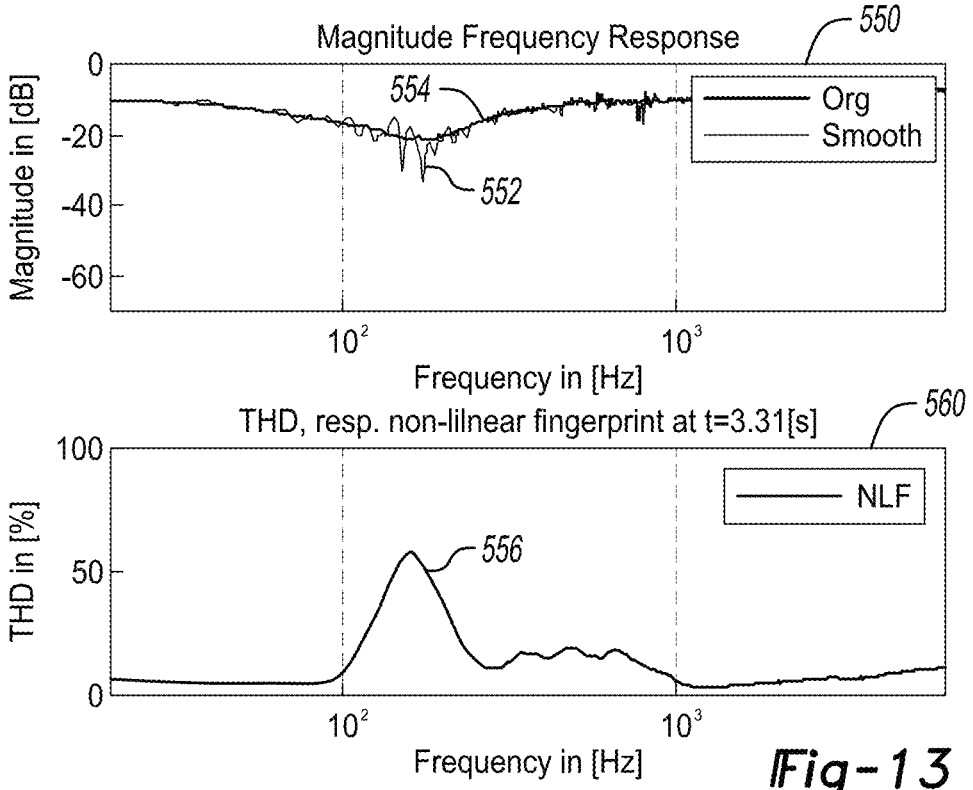
FIG. 13 generally depicts a first plot for a magnitude frequency response for an original and smoothed impedance curve and a second plot for the magnitude frequency response for the original and smoothed impedance curve in addition to corresponding NFP and THD function, respectively.

FIG. 13 generally depicts a first plot 550 and a second plot 560. With respect to the first plot 550, the magnitude response for an original impedance curve 552 and a smoothed impedance curve 554 is generally shown. The second plot 560 generally illustrates a waveform 556 corresponding to the NFP. As shown, the waveform 556 exhibits a peak at 150 Hz based on the shape of the EQ filter. The waveforms 554 and 556 generally illustrate that due to the effects of the spectral compressor 500, it is possible for the loudspeaker 154 to play back audio louder without the presence of disturbing distortion. Additionally, the waveforms 554 and 556 are indicative of more bass being present in the audio output.

Figure 14:
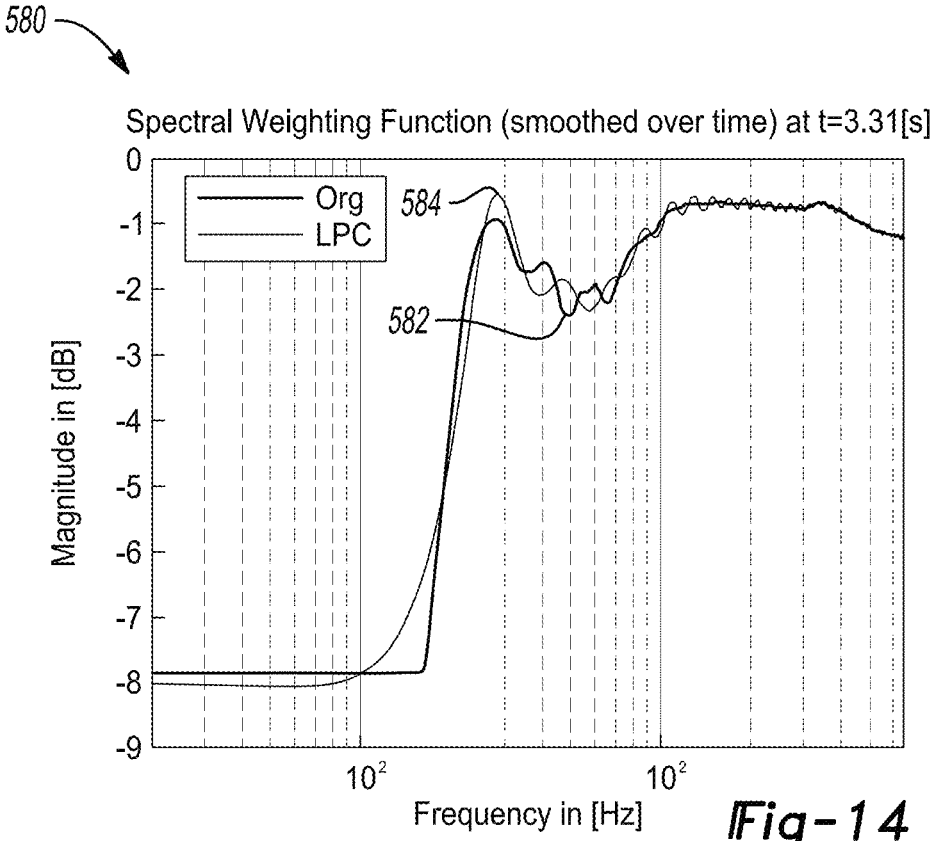
FIG. 14 generally depicts a corresponding EQ filter based on an underlying NFP that is realized as a finite impulse response (FIR) (Org) and approximated by an efficient linear prediction coding (LPC)

FIG. 14 generally depicts a plot 580 having a first waveform 582 that corresponds to a THD function and a second waveform 584 that exhibits the magnitude frequency response for an approximation by a 64 tap LPC FIR filter. The second waveform 584 illustrates that the limiting being performed is enough to avoid artifacts. The plot 580 is an exemplary plot of the spectral compressor.

Enlarged System with Spectral Compressor

FIG. 15 depicts an overall system 600 for loudspeaker optimization. The system 600 includes the controller 152, the loudspeaker 154, the audio source 156, the online parameters estimation block 172, the over-excursion limiter gain calculation block 176, the THD estimation block 456 and the NLF estimation block 470 (e.g., see calculation of distortions block) and the spectral compressor 500. The system 600 further includes a current sensor 602, an equalizing filter 604, an adjustable gain block 606, and a control block (e.g., adaptive filter control block (or least mean squares (LMS) control block)) 608, and an adder 610.

In general, the system 600 provides advanced loudspeaker protection via the over-excursion limiter gain calculation block 176 in addition to a thermal limiter (TL) that is driven by online estimates of required parameters ($R_{DC}$, $f_{DC}$, $f_{res}$, $Q_{TS}$, and L) of the unknown loudspeaker 154 by the parameter estimation block 192. As noted above, the spectral compressor 500 generally determines an estimate of the current nonlinear distortion for the loudspeaker 154 based on THD and the NLF from the calculation of distortions block 456, 470 and outputs the signal $h_{eq}(n)$. The current nonlinear distortion for the loudspeaker 154 includes distortions of the loudspeaker 154 that are not caused by harmonic parts, etc. The signal $h_{eq}(n)$ corresponds to a real-time estimate of current distortions of the loudspeaker 154. The equalizing filter 604 is configured to account for the real time distortions of the loudspeaker 154 in response to the signal $h_{eq}(n)$.

The signal $h_{EQ}(n)$ provides a spectral shape that varies over time n that may be applied to the equalizing filter 604. The equalizing filter 604 filters the incoming audio signal from the audio source 156 based on the signal $h_{eq}(n)$ to account for the distortions of the loudspeaker 154. The equalizing filter 604 is applied to the incoming audio signal x(t) before the gain G(n) is applied to the adjustable gain block 606 by the over-excursion limiter gain calculation block 176. The adjustable gain block 606 adjusts the gain output in response to the gain G(n) as received from the over-excursion limiter gain calculation block 176. As noted above, the over-excursion limiter gain calculation block 176 provides individual limiter gains for loudspeaker over-excursion as well as for the thermal limiter of the loudspeaker 154.

In general, the values for the signal $h_{eq}(n)$ and the gain G(n) adaptively change which modifies the loudspeaker driving signal (e.g. u(n)) and hence may directly influence the behavior and/or the functionality of the loudspeaker 154 that is tested and tuned in a closed loop. The analysis takes into account the real properties of the loudspeaker 154 (e.g., impedance). The system 600 is implemented as a hardware-in-the-loop system, since in this case the real, physical loudspeaker may be part of the system 600 itself, or by using a precise model of the used loudspeaker that is able to simulate the loudspeaker in its complex form (e.g., where also the nonlinear behavior of the loudspeaker 154 is considered within the model). The preferred hardware-in-the-loop version may require hardware that is capable of being, connected with a simulation system running at a personal computer (PC), thereby considering certain minimum latency requirements. Such an implementation may be expensive. To mitigate this issue, another method may be employed such as, for example, the usage of an elaborated loudspeaker model that directly runs within the simulation that was used instead to test the closed-loop of the system. For example, the loudspeaker 154 was first measured via a Klippel measurement system to obtain speaker parameters to model its complex behavior. Afterwards, those parameters were used in a generic speaker model to simulate the behavior of the measured loudspeaker. The control block 608 generally designates or serves as adaption control (e.g., LMS) for the adaptive filter 190. The adaptive filter 190 provides the signal g(n) (or g(z)) (e.g., the admittance or impedance) which is used by the online parameter estimation block 192 to determine the parameters noted above. The adaptive filter 190 also provides the signal $i_{est}(t)$ which corresponds to an estimated signal output from the loudspeaker 154 (or estimated varying signal i(t)). The adder 610 subtracts the signal $i_{est}(t)$ from i(t) to provide the desired error signal e(t) which is necessary for the calculation of the estimated distortion (e.g., the calculations of distortion blocks 456, 470). The spectral compressor 500 utilizes the distortion to generate the signal $h_{eq}(n)$.

As a result, the functionality of the spectral compressor 500 may be verified for example by a comparison of the NLF, before and after the application of the spectral compressor 500. A reduction of the nonlinear behavior may be observed if the spectral compressor 500 was activated, compared to the situation in which the spectral compressor 500 was not active. However, the desired manner of verification may be to listen to the output files, since now, with an activated spectral compressor 500 much more bass may be perceived, without perceptually disturbing acoustical artifacts being present once the spectral compressor 500 was well adjusted, compared to a classical way (e.g., via the utilization of a corresponding HP cross-over filter) to avoid acoustically disturbing artifacts. It may further be verified by way of analysis of the output signals (e.g., see signals in FIG. 16 that illustrate the signals as radiated by the loudspeaker 154 (i.e., perceived by the listener)) that, by a tuned spectral compressor 500, some harmonic distortions may still remain in the spectrum of the output signal, despite the fact that those were not perceptional disturbing. The harmonic distortions that remain below the main spectral peaks will be successfully masked. This may establish that the spectral compressor 500 is capable of enhancing the bass performance of the loudspeaker 154 to achieve maximum bass performance, which already exceeds the physical limits of the loudspeaker 154, but still remained below a psychoacoustically acceptable limit.

Figure 16A:
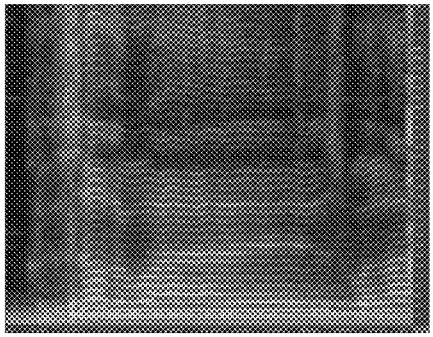
FIG. 16A-16C generally depict spectrograms of the loudspeaker with different settings for the spectral compressor.

FIG. 16A generally depicts a spectrogram of the loudspeaker 154 when the spectral compressor 500 is not used. For example, in FIG. 16A, acoustical artifacts may be perceived. In particular, it can be seen, that in-between the formats of the voice signal (i.e., audio output signal), other signals are present, stemming from the non-linearities created by the heavy bass (e.g., high energy content at (very) low frequencies), which may be present in the signal as well.

Figure 16B:
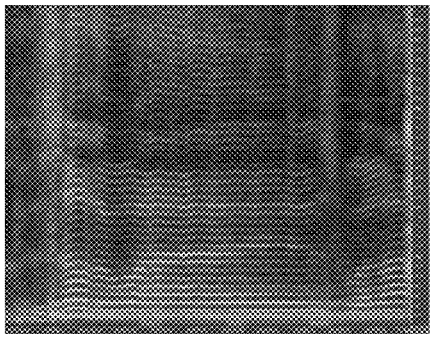

FIG. 16B generally depicts the spectrogram for the loudspeaker 154 when the spectral compressor 500 is activated and conservatively tuned (e.g., by using a $2^{nd}$ order HP filter below $f_{Max}$ (e.g., the HP filter 528 as shown in connection with FIG. 12)). FIG. 16B generally illustrates that the spectral regions in-between the formats of the voice signal (horizontal, spectral lines) are much less contaminated by the non-linearities of the loudspeaker 154. This may be the case, since, due to the HP filter 528, the energy at low frequencies has been reduced. As a result, disturbing acoustical artifacts may not be perceivable anymore and that the bass performance has been reduced as well.

Figure 16C:
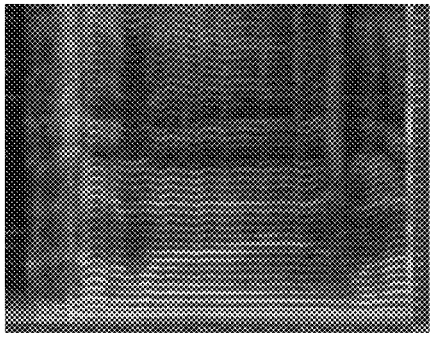

FIG. 16C generally depicts the spectrogram for the loudspeaker 154 when the spectral compressor 500 is activated and the HP filter 528 is deactivate. As shown, portions of the non-linear by-products in-between the formants of the voice re-appear but are less pronounced as if the spectral compressor 500 was inactive. On the other hand, the bass content (or bass performance) has improved in comparison to the conservatively tuned case as illustrated in FIG. 16B. Also, in this case, no acoustical artifacts can be perceived, despite the fact, that an improved bass performance in comparison to the conservatively adjusted case is now present.

Linearizer

While the spectral compressor 500 may reduce certain spectral regions at which the nonlinear distortion becomes too high, to eventually limit the overall, nonlinear distortion of the loudspeaker 154 to a certain threshold, it may not represent a so-called "linearizer". The functional principle of a classical linearizer may be given if the driving signal of the loudspeaker 154 is pre-distorted to compensate for the distortions of the non-linearities to eventually linearize the loudspeaker.

This task may be achieved, for example, if the unknown loudspeaker 154 can precisely be modeled, including the non-linear behavior. In case such a model can successfully be estimated during normal operation, by then predictable distortions of the loudspeaker 154 can be estimated as well and, as a consequence be also compensated, by way of a so-called mirror filter, creating the before-mentioned pre-distortion of the driving signal (e.g., u(t)) for the loudspeaker 154.

Figure 17:
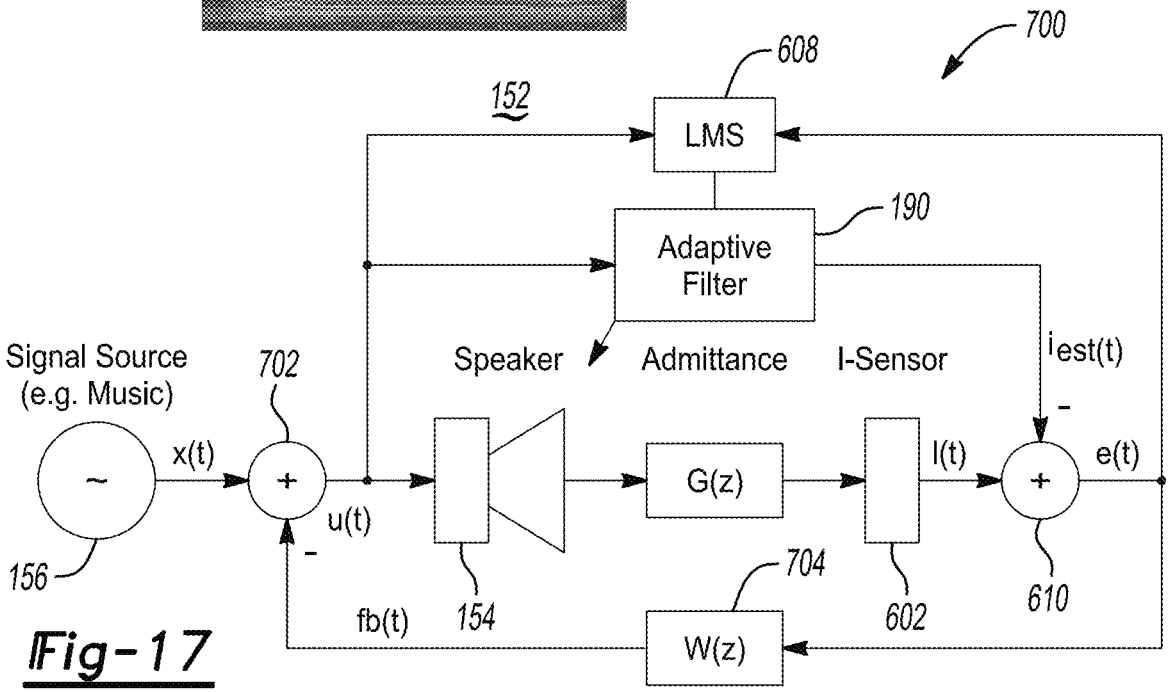
FIG. 17 generally depicts a system that provides a current based feedback linearizer in accordance to one embodiment.

FIG. 17 generally depicts a system 700 that provides a current based feedback linearizer in accordance to one embodiment. The system 700 includes the controller 152, the loudspeaker 154, the audio source 156, the adaptive filter 190, the current sensor 602, the control block 608 (or adaptive filter controller), the adder 610, another adder 702, and a linearizer 704 (or feedback filter). The system 700 may utilize the linearizer 704 and an output therefrom as a feedback signal. In operation, the linearizer 704 receives the error signal e(n) from the adaptive filter 190. The error signal e(n) generally provides information that is indicative of the nonlinear part of the admittance curve G(z) over time which also represents the sum of all of the nonlinear by-products of the loudspeaker 154. It is recognized that G(z) represents the real system, which includes not only linear products, but also the sum of all nonlinear by-products. However, since a "normal" adaptive system is only able to estimate linear systems (LTI (Linear-Time-Invariant)-systems), it is clear, that an estimated current signal $i_{est}(t)$ (e.g., estimated current signal that is being generated by the loudspeaker 154) as output from the adaptive filter 190 represents the linear part (or linear products). Thus, after subtraction via the adder 610 of the estimate from the real current signal $i_{est}(t)$ from of the varying current i(t), the resulting error signal e(t) represents the sum of all nonlinear by-products. This signal is then used as input to the linearizer filter 704.

In this case, the linearizer 704 models the predictable distortions of the loudspeaker 154 based in the error signal e(n) from the adaptive filter 190 and transmits a feedback control signal fb(t) to the adder 702 which is subtracted from the incoming audio signal x(t). Thus, the indication of the non-linear by products of the loudspeaker 154 via the signal fb(t) may be subtracted from the incoming audio signal x(t) to compensate for the non-linear by products of the loudspeaker 154.

Another way to realize such a linearizer is by way of feedback (FB) control, known e.g. from feedback active noise control (ANC) systems, as illustrated by the FD in FIG. 15. Basically, the feedback-loop is driven by the error signal e(n) of the adaptive filter 190, which estimates the linear part of the admittance curve/transfer function G(z)

over time and also represents the sum of all nonlinear by-products of the loudspeaker 154.

Example Design of the Filter W(z) for a Feedback Controlled Linearizer

Figure 18:
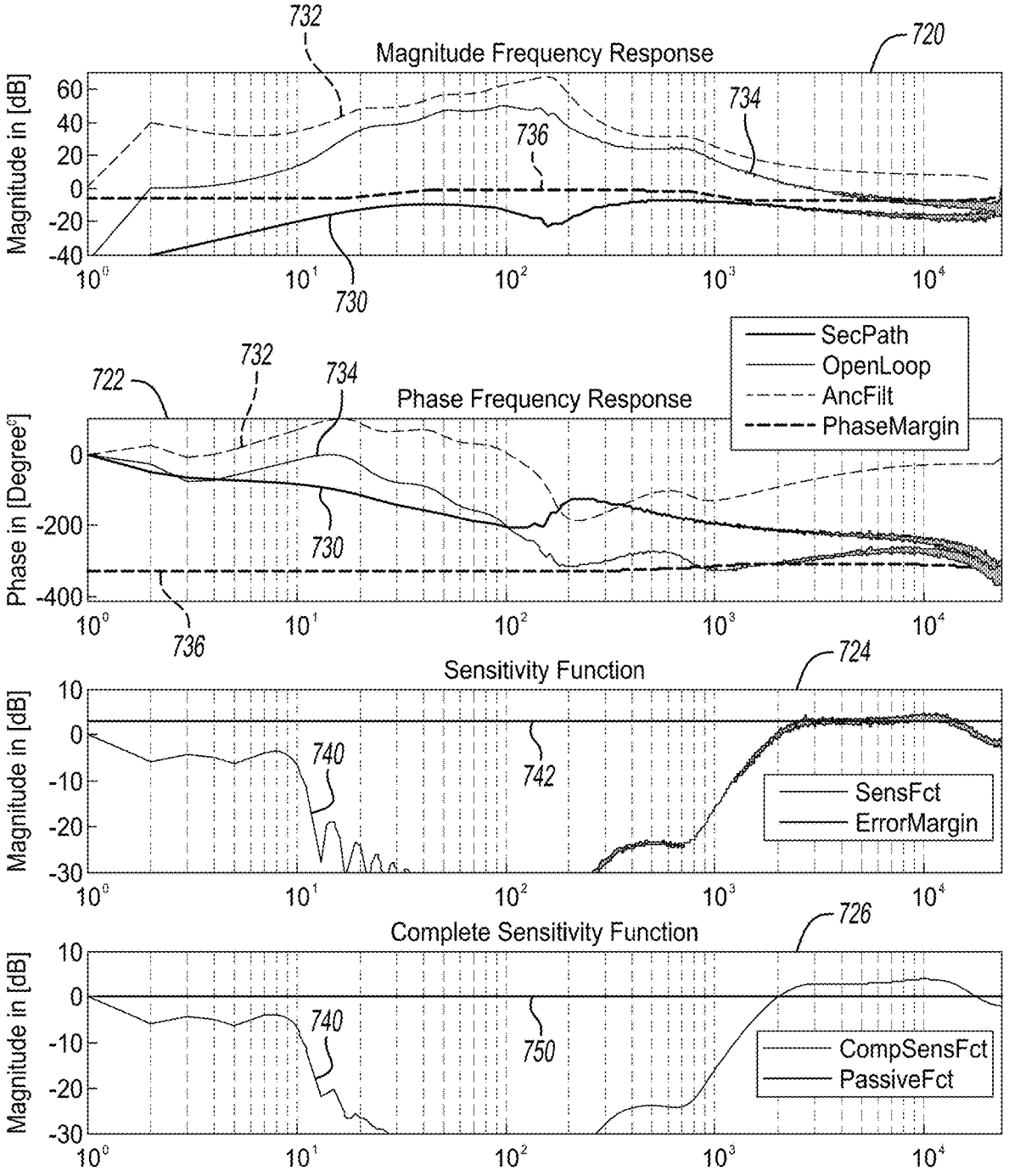
FIG. 18 generally depicts various plots for magnitude frequency response, phase frequency response, sensitivity function, and a smoothed sensitive function for a feedback filter in accordance to one embodiment.

FIG. 18 generally illustrates plots 720, 722, 724, and 726 that depict a magnitude frequency response, phase frequency response, sensitivity function, and complete (smoothed) sensitivity function, respectively, for aspects related to the linearizer 704. Waveform 730 as illustrated in the plots 720 and 722 represents the underlying admittance function G(z), which corresponds to the linear system. Waveform 732 represents a Bode diagram of the linearizer 704. Waveform 734 represents an open loop system, given by HOL(z)=G(z)*W(z) and waveform 736 represent limits, in particular the desired amplitude and phase margin, respectively. The waveform 740 in the plots 724 and 726 represent a sensitivity function and waveform 742 in plot 724 represents an adjusted error margin. Waveform 740 in the plot 726 represents a smoothed sensitivity function, which, in principle may show the frequency dependent, achievable reduction of nonlinear by-products of the loudspeaker 154 and also provides a measure of how well the loudspeaker 154 may be linearized at a corresponding spectral area.

Figure 19:
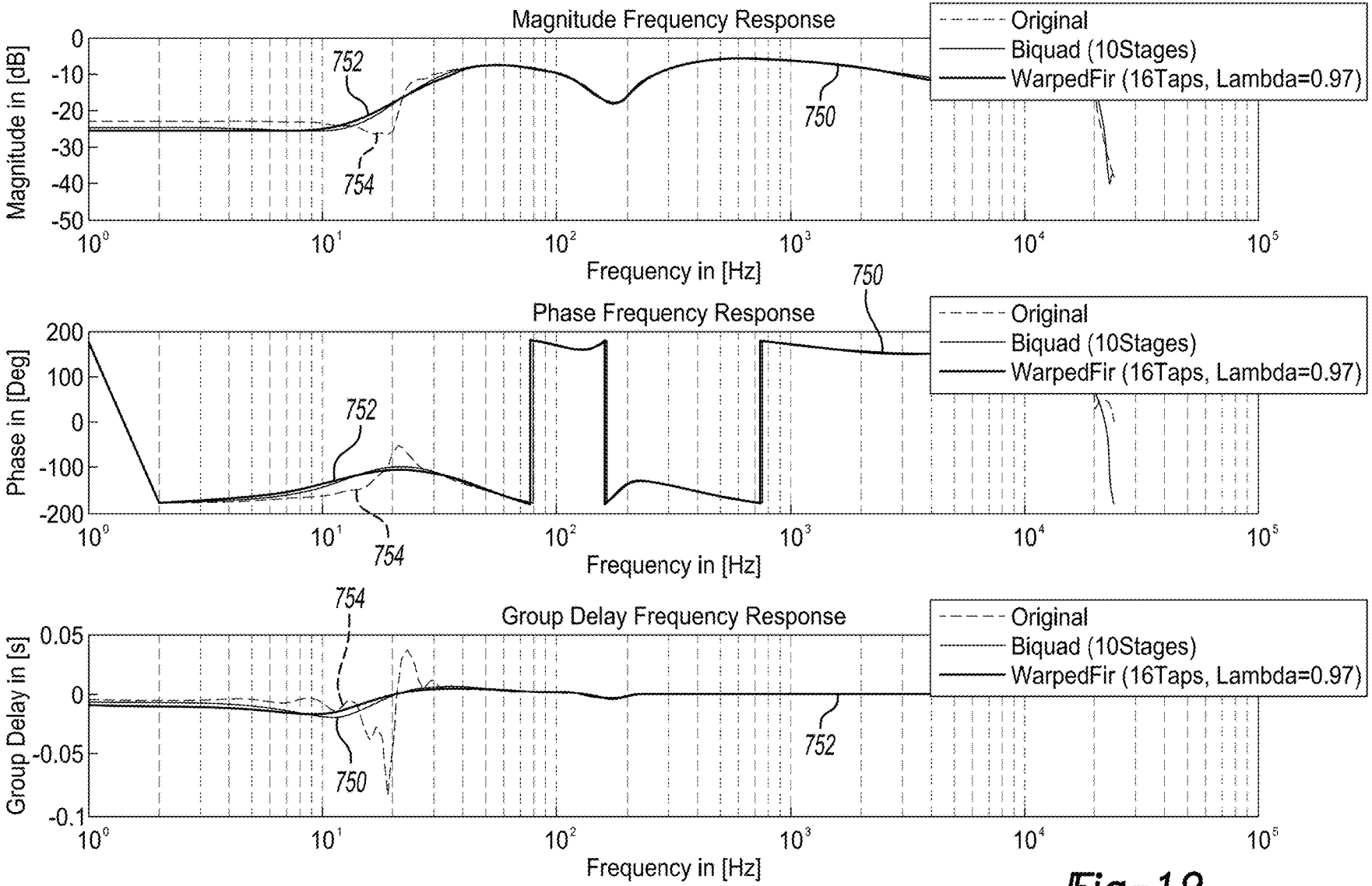
FIG. 19 generally depicts an approximation of the admittance curve of a loudspeaker by bi-quads and a warped (FIR) filter.
Figure 20:
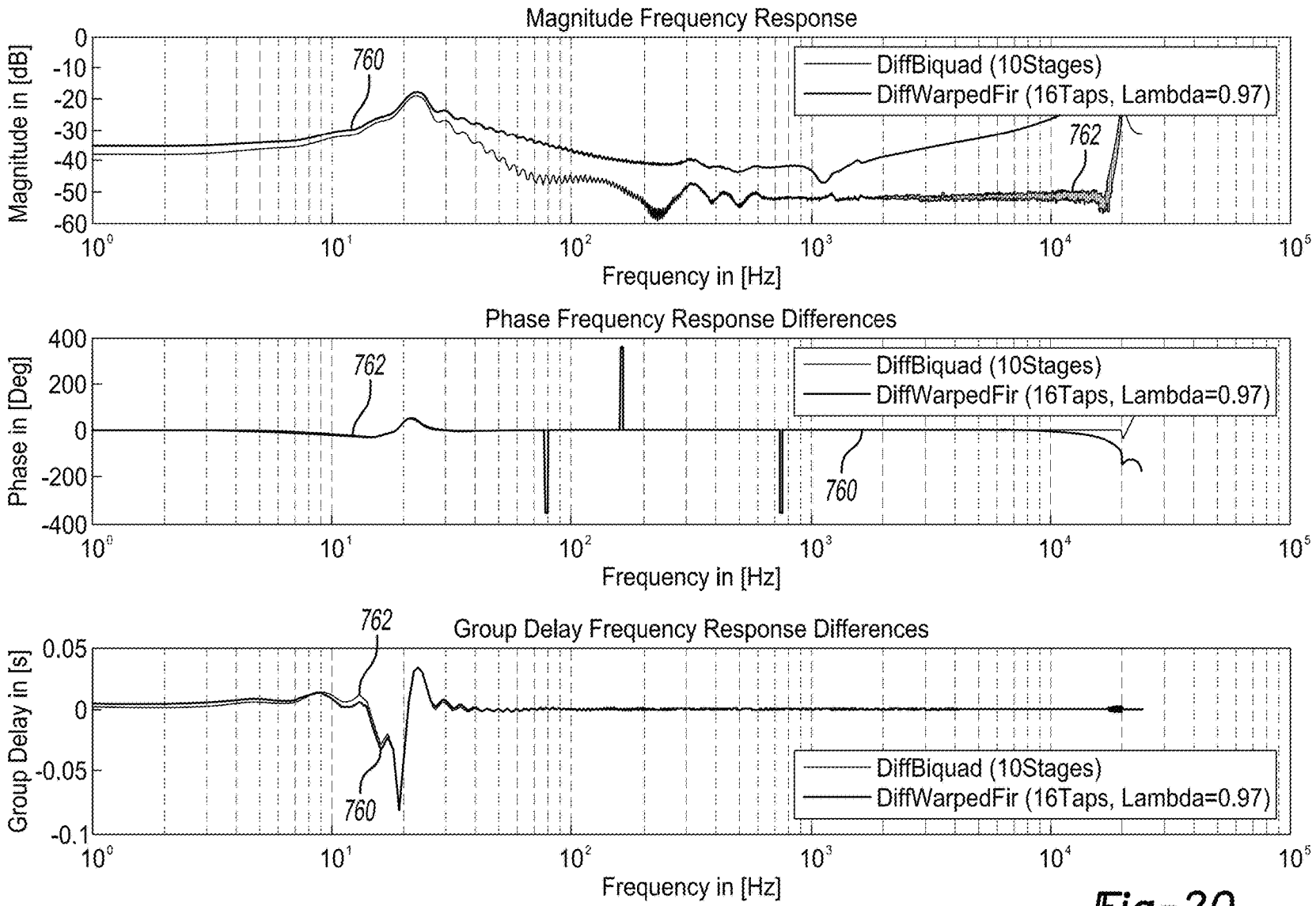
FIG. 20 generally depicts an overall quality (differences) of an approximation of the admittance curve of a loudspeaker by bi-quads and a warped (FIR) filter.

The data as provided in the plots 720, 722, 724, and 726 may indicate promising results. For example, a real-time system may be provided to verify functionality of the feedback control-based linearizer 704. In addition, the real-time system may need to fulfill requirements regarding latency, otherwise, a proper operation may not be possible. Finally, such a low-latency, real-time system may include an evaluation board of, for example, a Sigma 50 digital signal processor (DSP) from Analog Devices (ADI), which may also be programmed with acceptable effort. The DSP may not provide enough signal processing power to realize an online estimation of the admittance function G(z) with enough spectral resolution, i.e. with a long enough FIR filter. As a consequence, for verification tests, the adaptively adjusted estimate of G(z) was replaced by a fixed filter, thereby approximating the fixed filter's linear characteristic. The approximation by a couple of 2nd order IIR filter (Biquads) (see waveform 750 in FIG. 19) was investigated as well as the use of short, warped FIR (WFIR) filter (see waveform 752 in FIG. 19). Waveform 754 in FIG. 19 illustrates an original admittance function G(z). Both of those versions (see waveforms 750 and 752) may be able to mimic a given linear part of the admittance function G(z) up to about 60 [dB], as shown in FIG. 19 and FIG. 20. Thereby the spectral region of interest to be approximated is at or around the resonance frequency of the used loudspeaker 154, since here, as already shown before, the largest distortions may appear. It is recognized that a fixed filter (not shown) may be utilized instead of the adaptive filter 190 and the control block 608. In reference to FIG. 17, the control block 608 may be removed and the adaptive filter 190 may be replaced with the fixed filter. In short, the implementation of the adaptive filter 190 corresponds to a linearizer and the utilization of the fixed filter (e.g., approximating a reference admittance or impedance) causes the feedback system 700 to match the used loudspeaker 154 to fit to this reference admittance or impedance which may be interpreted as an automatic matching system.

In FIG. 20, waveforms 760 and 762 depict differences between the underlying/original admittance function G(z) and its approximations by a 10 Biquads and a 16 Tap WFIR filter, respectively. In general, FIG. 20 illustrates that both approximations may be able to achieve acceptable results. One aspect that may be considered with this system is, that the actual shape of G(z) may vary or slightly vary over time, which may have a negative impact to the verification results. Thus, it may be preferred to use the current error signal e(n) to feed the linearizer 704, based on the actual estimate of G(z), to achieve the highest linearization effect, but in case a fix approximation of the linear part of G(z) or a replica of a desired, admittance function $G_{Ref}(z)$ of a reference speaker is used instead. The linearizer 704 may automatically move the current loudspeaker 154 to this target. The linearizer 704 may try to automatically mimic properties (e.g., the properties at least defined by a (complex) admittance curve) of the desired reference loudspeaker, which may yet be another useful possibility to use the linearizer 704 in a beneficial way.

Figure 21A:
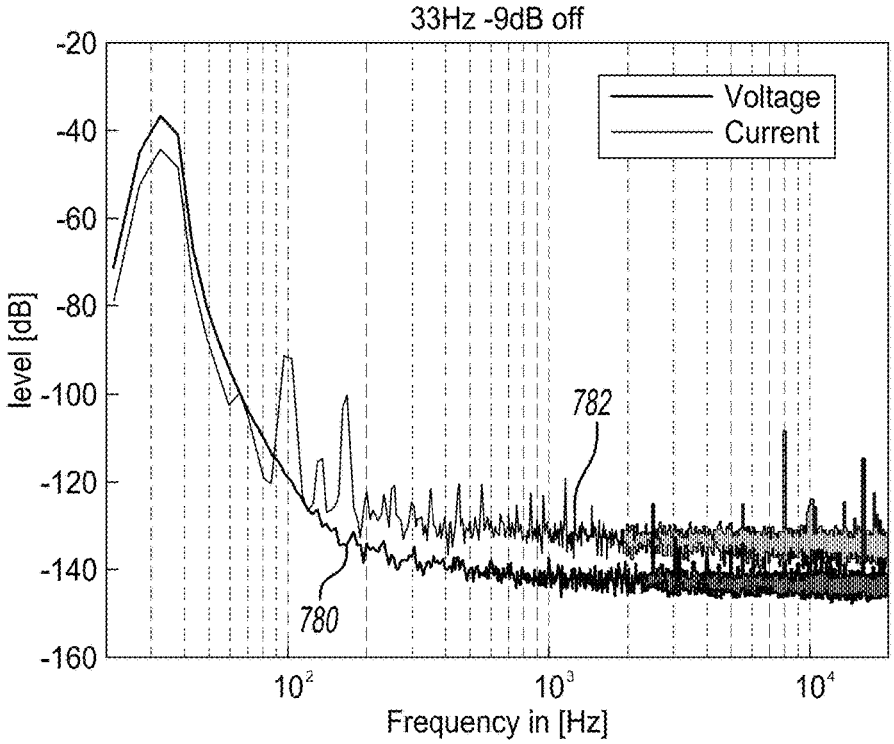
FIGS. 21A-21B generally depict real time test examples/results of the functionality of a current based feedback linearizer with the linearizer being switched off and the linearizer being switched on, respectively.
Figure 21B:
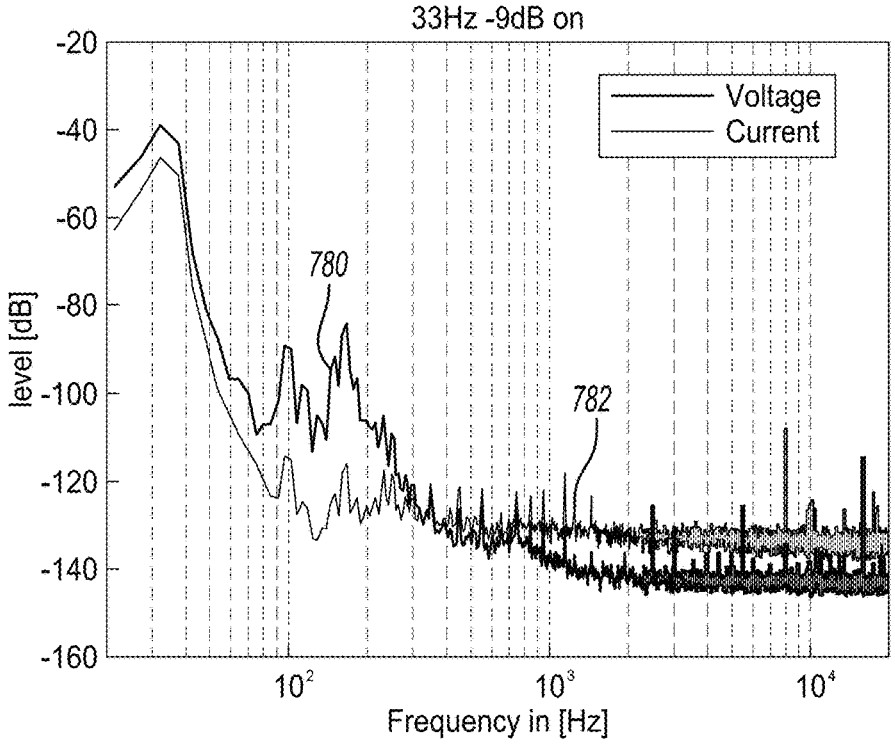

FIGS. 21A-21B generally depict a real time test example of functionality of a current based feedback linearizer 704 with the linearizer 704 being switched off and the linearizer being switched on, respectively. As illustrated in FIG. 21B, first real-time tests may reveal that in principle this system works, as a reduction of approximately 20 [dB] of the first couple of higher harmonics, i.e. of K2 and K3, may be achieved by usage of a low frequency sinusoid as an input signal, at which those nonlinearities are generated. Higher harmonics may still reside at frequencies where the latency was still in an acceptable range to allow a proper functionality. This may be the case since during the test, only a sampling rate of fs=48 [kHz], respectively fs=96 [kHz] was used, which usually is too low for proper feedback control, as described above. Using a higher sampling rate, leading to a lower, overall latency, may allow control at higher spectral ranges.

Waveforms 780 and 782 (e.g., current and voltage) of FIG. 21A-21B reveal, that the linearizer 704 may modify the driving signal (e.g., u(t)) that drives the loudspeaker 154 (e.g. see waveform 780 of FIG. 21B). As noted above in FIG. 21A, where the linearizer 704 is deactivated, waveform 780 shows that the driving signal only contains the input signal (e.g., a sinusoidal wave with frequency $f_{test}$=33 [Hz]). However, waveform 780 in FIG. 21B reveals that the waveform 782 (e.g., loudspeaker driving signal) now includes beside the still dominating input signal (sine wave at $f_{test}$=33 [Hz]) a large number of additional signal parts, reaching approximately up to f~250 [Hz]. These additional signal parts are generated, based on the error signal e(n), that are filtered by the linearizer 704 and may eventually enable a reduction of non-linear distortions of the system. This may be seen upon examining the waveform 782 in FIGS. 21A-21B. FIG. 21A illustrates a typical picture of the current of a non-linear system, since non-negligible signal parts exist at higher harmonics, such as K2 and K3, but also of some intermediate non-linearities which, for example, resides in-between K2 and K3. After the linearizer 704 is switched on, the resulting loudspeaker driving signal is pre-distorted (e.g., see waveform 780), as already noted above, leading to a linearization of the effective current signal 782 as illustrated in FIG. 21B. The harmonics K2 and K3, as well as a non-harmonic part which resides in-between, may be reduced. Thereby the linear part may not be affected, since the current may not change between the plots illustrated in FIGS. 21A and 21B. Thus, the approximation of the linear part of the admittance curve of the loudspeaker 154 (e.g., as achieved by 10 Biquads), and noted above operate as intended.

System for Loudspeaker Optimization

Figure 22:
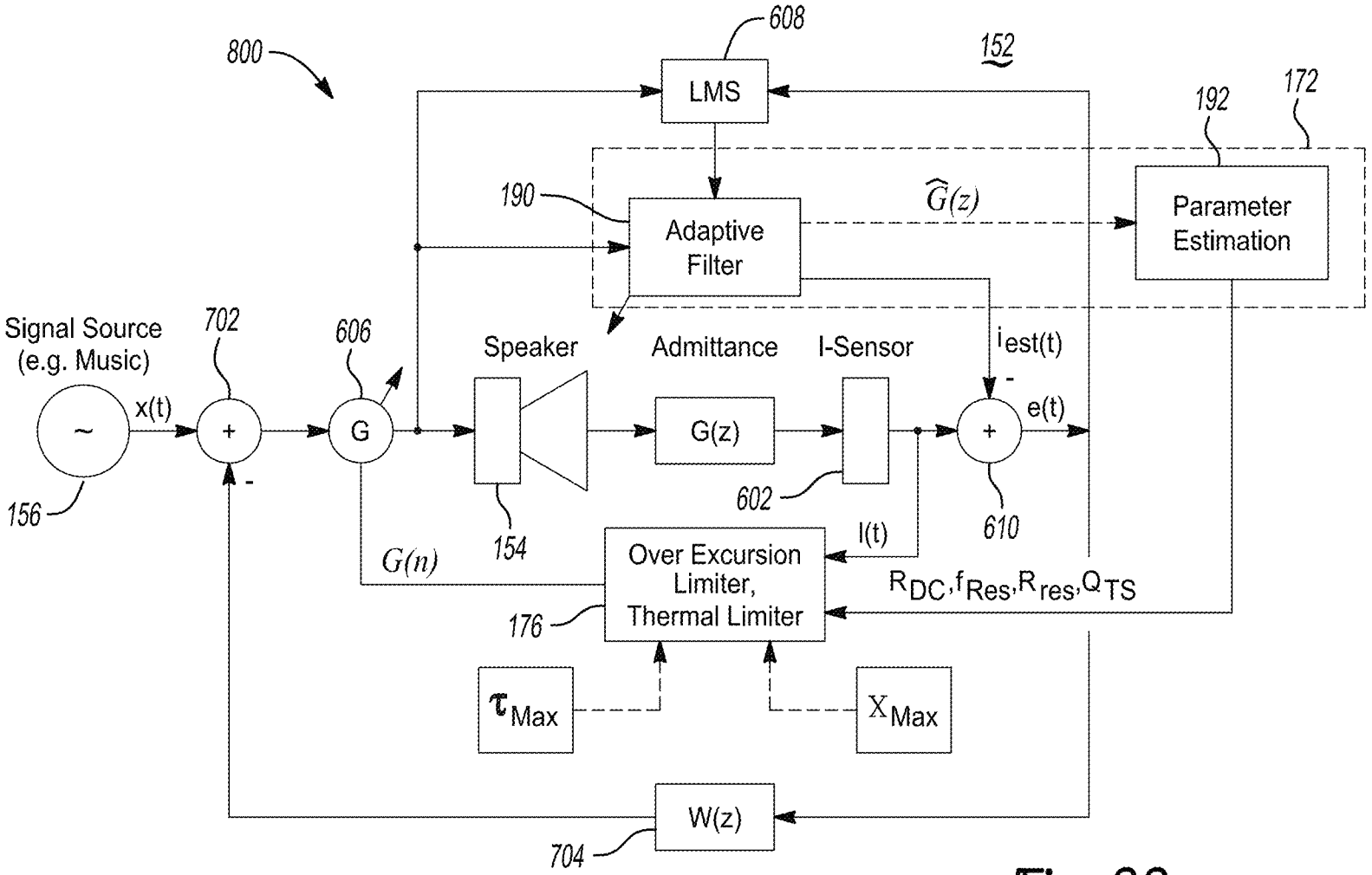
FIG. 22 generally depicts a system that combines a current based feedback linearizer with an advanced system that protects the loudspeaker against thermal and over-excursion overloads in accordance to one embodiment.

FIG. 22 generally depicts a system 800 that combines the current based feedback linearizer 704 with the over-excursion limiter block 176 in accordance to one embodiment. The systems 800 includes elements/features (e.g., the controller 152, the loudspeaker 154, the audio source 156, the on-line parameter estimation block 172, the over-excursion limiter block 176, the current sensor 602, the adjustable gain block 606, the control block 608 (or adaptive filter control block 608), the adders 610, 702, the adaptive filter 190, etc.) that have been described in detail above. The description of these elements/features as described above also apply to the system 800.

Figure 23:
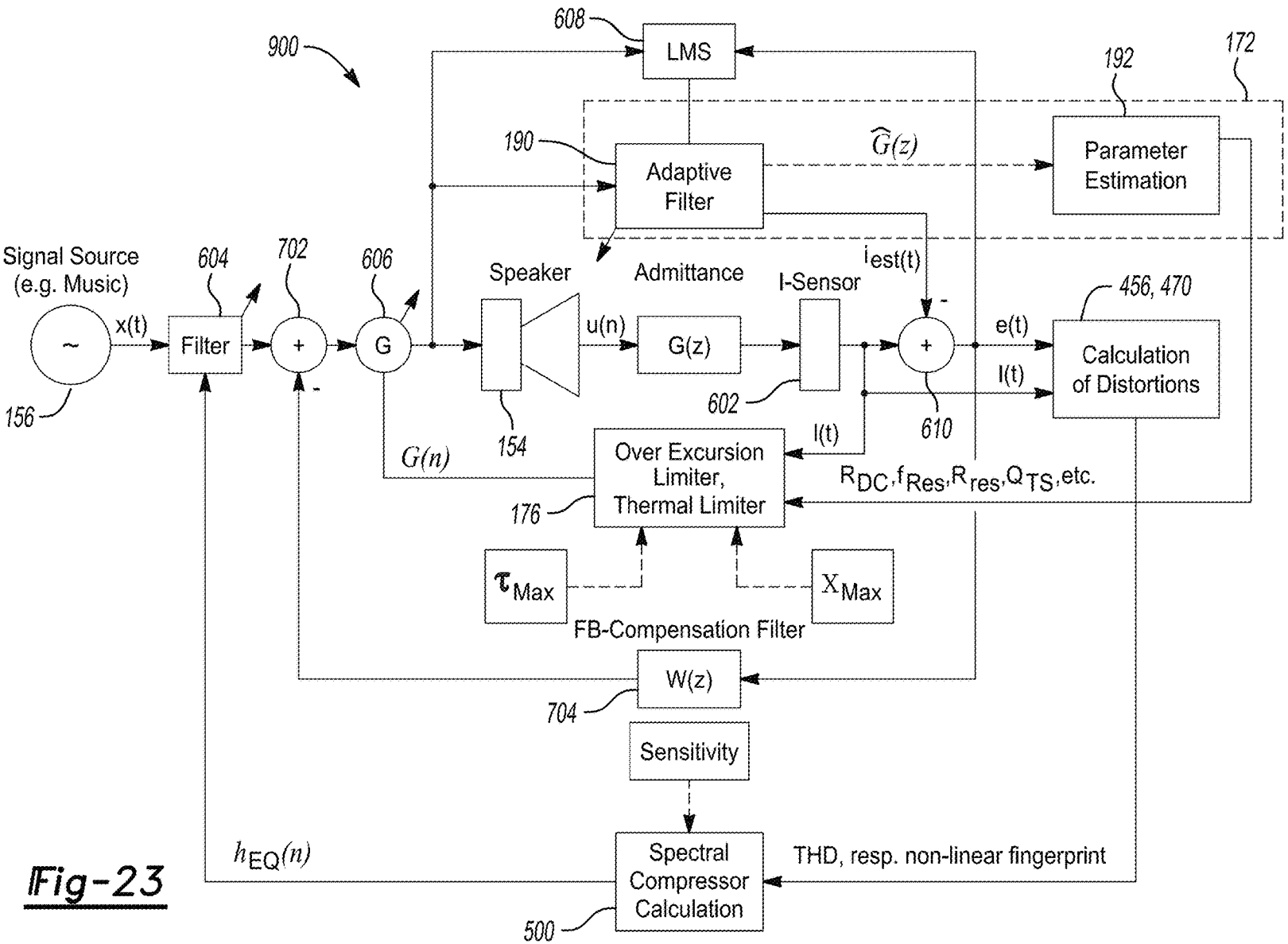
FIG. 23 generally depicts an overall system that provides advanced loudspeaker protection against thermal and over-excursion overloads, and an adaptive spectral compressor, as a linearizer based on feedback control, in accordance to one embodiment.

FIG. 23 generally depicts a system 900 that combines the over-excursion limiter block 176, the spectral compressor 500, and the linearizer 704 in accordance to one embodiment. The systems 900 includes elements/features (e.g., the controller 152, the loudspeaker 154, the audio source 156, the on-line parameter estimation block 172, the over-excursion limiter block 176, the adaptive filter 190, the spectral compressor 500, the current sensor 602, the adjustable gain block 606, the control block 608, the adders 610, 702, the linearizer 704, etc.) that have been described in detail above. The description of these elements/features as described above also apply to the system 800.

The system 900 generally provides optimal performance for the loudspeaker 154 without damaging the same. It is recognized that the current sensor 602, which may be readily integrated into integrated circuits of an amplifier may or may not increase hardware (HW) costs. From the controller 152 and memory perspective, instructions to execute the various features noted herein may require additional effort since adaptive filtering, estimating the current admittance curve G(z) in real-time, may be needed, together with, for example, at least two additional filters. The filter may realize the spectral shaping filter of the spectral compressor 500 as well as. for example, the IIR filter based, feedback filter W(z) of the linearizer 704. Thereby, the actual core (e.g., FIR filter G(z)) of the adaptive filter 190 may be realized similar to the linearizer 704 at a high sampling rate to keep its latency low, whereas the actual adaptation may be realized at a lower sampling rate, thereby using an efficient block processing, most efficiently realized in the spectral domain, if desired. Also, the over-excursion limiter block 176 (including the thermal limiter) may deliver the gain G(n) which may be realized at high frequencies, but since a single gain may be used, the real-time effort for this part may be negligible.

To keep the software related effort low when executed in the controllers as set forth herein, several measures have been set forth herein, such as, for example, the utilization of an efficient LPC FIR filter of a reduced length (e.g. 64 [Taps]) may be used for the realization of the spectral compressor 500 instead of a linear, and/or minimum-phase FIR filter. Utilization of block processing (e.g., most efficiently in the spectral domain) and/or downsampling for the realization of the adaptive FIR filter as well as usage of (minimum-phase) IIR filter, realized by a couple (<=10) of ordinary Biquads, may be used for the implementation of the feedback filter W(z) (or linearizer 704). With those efficiency enhancing measures, such a system may be realized with any processor of ordinary performance.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An audio system for extracting online parameters, the system comprising:

a loudspeaker for transmitting an audio signal in a listening environment; and at least one controller including:

a signal processing block programmed to provide a driving signal to drive the loudspeaker to transmit the audio signal; and an adaptive filter programmed to:

receive the driving signal;

receive a first varying signal from the loudspeaker in response to the loudspeaker transmitting audio signal;

generate an admittance curve for the loudspeaker based at least on the driving signal and the first varying signal;

determine an impedance curve of the loudspeaker based on the admittance curve; and determine a direct current (DC) resistance of a voice coil of the loudspeaker based at least on the impedance curve or the admittance curve of the loudspeaker.

2. The audio system of claim 1, wherein the at least one controller is further programmed to determine at least a quality of a total and complete system at least based on a magnitude frequency response of the admittance curve or the impedance curve.

3. The audio system of claim 1, wherein the at least one controller is further programmed to determine a resonance frequency of the loudspeaker based at least on a group delay frequency response of the admittance curve or the impedance curve.

4. The audio system of claim 1, wherein the at least one controller is further programmed to determine an inductance of the loudspeaker based on the admittance curve or the impedance curve of the loudspeaker.

5. The audio system of claim 1, wherein the driving signal is a voltage varying signal and the first varying signal is a current varying signal and wherein the adaptive filter is programmed to generate the admittance curve based on the voltage varying signal and the current varying signal.

6. The audio system of claim 1, wherein the driving signal is a current varying signal and the first varying signal is a voltage varying signal and wherein the adaptive filter is programmed to generate an impedance curve based on the voltage varying signal and the current varying signal.

7. The audio system of claim 1 further comprising an over excursion gain limiter block programmed to limit travel of a voice coil of the loudspeaker based at least on the admittance curve or an impedance curve of the loudspeaker.

8. The audio system of claim 1 further comprising a thermal model gain calculation block programmed to limit a temperature of loudspeaker based on a resistance of a voice coil of the loudspeaker and the first varying signal.

9. The audio system of claim 1 further comprising a linearizer programmed to receive an error signal that is indicative of a sum of all non-linear by-products of the admittance curve or an impedance curve of the loudspeaker.

10. The audio system of claim 1, wherein a nonlinear portion of the admittance curve or an impedance curve of the loudspeaker represents a sum of all nonlinear by-products of the loudspeaker.

11. The audio system of claim 1 further comprising a calculation of distortion block that is programmed to generate a first signal corresponding to a nonlinear distortion of the loudspeaker based on at least one of an error signal and higher harmonics of the driving signal.

12. The audio system of claim 11, wherein the error signal corresponds to a difference between an estimated first varying signal and the first varying signal that is measured from the loudspeaker.

13. The audio system of claim 11, wherein the first signal corresponds to one of a total harmonic distortion (THD) of the loudspeaker and a non-linear fingerprint (NLF) of the loudspeaker.

14. The audio system of claim 11 further comprising a spectral compressor programmed to generate filter coefficients for an equalizing filter that is applied to an incoming audio signal based on an estimated non-linear distortion of the loudspeaker and to counteract for distortions associated with the loudspeaker.

15. The audio system of claim 1 further comprising an adaptive control block programmed to control the adaptive filter to generate the admittance curve or an impedance curve for the loudspeaker at least in response to the driving signal exceeding a minimum power level.

16. The audio system of claim 15, wherein the adaptive control block is further programmed to control the adaptive filter to generate the admittance curve or an impedance curve for the loudspeaker in response to an input spectrum of the driving signal including energy at or around a resonance frequency of the loudspeaker.

17. A computer-program product embodied in a non-transitory computer read-able medium that is programmed for extracting online parameters associated with a loudspeaker, the computer-program product comprising instructions for:

providing a driving signal to drive the loudspeaker to transmit an audio signal;

receiving a varying signal from the loudspeaker in response to the loudspeaker transmitting audio signal;

generating one of an admittance curve or an impedance curve for the loudspeaker based at least on the driving signal and the varying signal; and determining a direct current (DC) resistance of a voice coil of the loudspeaker based at least on the impedance curve or the admittance curve of the loudspeaker.

18. A method for extracting online parameters associated with a loudspeaker, the method comprising:

providing a driving signal to drive the loudspeaker to transmit an audio signal;

receiving a varying signal from the loudspeaker in response to the loudspeaker transmitting audio signal;

generating an admittance curve or an impedance curve for the loudspeaker based at least on the driving signal and the varying signal; and determining an inductance of the loudspeaker based on the admittance curve or the impedance curve of the loudspeaker.

19. An audio system for extracting online parameters, the system comprising:

a loudspeaker for transmitting an audio signal in a listening environment; and at least one controller including:

a signal processing block programmed to provide a driving signal to drive the loudspeaker to transmit the audio signal; and an adaptive filter programmed to:

receive the driving signal;

receive a first varying signal from the loudspeaker in response to the loudspeaker transmitting audio signal;

generate an admittance curve for the loudspeaker based at least on the driving signal and the first varying signal;

determine an impedance curve of the loudspeaker based on the admittance curve; and determine a resonance frequency of the loudspeaker based at least on a group delay frequency response of the admittance curve or the impedance curve.

20. An audio system for extracting online parameters, the system comprising:

a loudspeaker for transmitting an audio signal in a listening environment; and at least one controller including:

a signal processing block programmed to provide a driving signal u(n) to drive the loudspeaker to transmit the audio signal; and an adaptive filter programmed to:

receive the driving signal;

receive a first varying signal from the loudspeaker in response to the loudspeaker transmitting audio signal;

generate an admittance curve for the loudspeaker based at least on the driving signal and the first varying signal;

determine an impedance curve of the loudspeaker based on the admittance curve; and determine an inductance of the loudspeaker based on the admittance curve or the impedance curve of the loudspeaker.

21. An audio system for extracting online parameters, the system comprising:

a loudspeaker for transmitting an audio signal in a listening environment; and at least one controller including:

a signal processing block programmed to provide a driving signal to drive the loudspeaker to transmit the audio signal; and an adaptive filter programmed to:

receive the driving signal;

receive a first varying signal from the loudspeaker in response to the loudspeaker transmitting audio signal; and generate an admittance curve for the loudspeaker based at least on the driving signal and the first varying signal; and a calculation of distortion block that is programmed to generate a first signal corresponding to a nonlinear distortion of the loudspeaker based on at least one of an error signal and higher harmonics of the driving signal.

22. An audio system for extracting online parameters, the system comprising:

a loudspeaker for transmitting an audio signal in a listening environment; and at least one controller including:

a signal processing block programmed to provide a driving signal u(n) to drive the loudspeaker to transmit the audio signal; and an adaptive filter programmed to:

receive the driving signal;

receive a first varying signal from the loudspeaker in response to the loudspeaker transmitting audio signal; and generate an admittance curve for the loudspeaker based at least on the driving signal and the first varying signal, and an adaptive control block programmed to control the adaptive filter to generate the admittance curve or an impedance curve for the loudspeaker at least in response to the driving signal exceeding a minimum power level.

23. A computer-program product embodied in a non-transitory computer read-able medium that is programmed for extracting online parameters associated with a loudspeaker, the computer-program product comprising instructions for:

providing a driving signal to drive the loudspeaker to transmit an audio signal;

receiving a varying signal from the loudspeaker in response to the loudspeaker transmitting audio signal;

generating one of an admittance curve or an impedance curve for the loudspeaker based at least on the driving signal and the varying signal; and determining a resonance frequency of the loudspeaker based at least on a group delay frequency response of the admittance curve or the impedance curve.

* * * * *